US011840842B2

(12) United States Patent
Kaplan et al.

(10) Patent No.: US 11,840,842 B2
(45) Date of Patent: Dec. 12, 2023

(54) LATCHING RAILING ARRANGEMENT

(71) Applicant: Fiber Composites, LLC, New London, NC (US)

(72) Inventors: Patrick Michael Kaplan, Sylvania, OH (US); Kyle Robert Wilkinson, Concord, NC (US); Petros D. Kotiadis, Albemarle, NC (US); Rick Allan Lappin, New London, NC (US); Richard Rex Bottles, Charlotte, NC (US); Eric Douglas Sanford, Milwaukee, WI (US); Mark Beckner, Wildomar, CA (US); Kai Chen, Riverside, CA (US)

(73) Assignee: Fiber Composites, LLC, New London, NC (US)

( * ) Notice: Subject to any disclaimer, the term of this patent is extended or adjusted under 35 U.S.C. 154(b) by 182 days.

(21) Appl. No.: 17/398,526

(22) Filed: Aug. 10, 2021

(65) Prior Publication Data

US 2022/0047076 A1 Feb. 17, 2022

Related U.S. Application Data

(60) Provisional application No. 63/064,012, filed on Aug. 11, 2020.

(51) Int. Cl.
*E04F 11/18* (2006.01)

(52) U.S. Cl.
CPC ... *E04F 11/1817* (2013.01); *E04F 2011/1821* (2013.01)

(58) Field of Classification Search
CPC ..... E04H 17/1447; E04H 17/1448; E04H 17/1452; E04H 17/1488; E04F 11/18;
(Continued)

(56) References Cited

U.S. PATENT DOCUMENTS 3,516,644 A * 6/1970 Horgan, Jr. ..... E04F 11/1836 403/321
5,421,556 A * 6/1995 Dodge ..... E04H 17/20 403/375

(Continued)

FOREIGN PATENT DOCUMENTS

CA 1232161 A * 2/1988 ..... E04F 11/181
CA 2638297 A1 * 1/2010 ..... E04F 11/1812

(Continued)

OTHER PUBLICATIONS

Invitation to Pay Additional Fees from PCT/US21/45359 dated Oct. 18, 2021 (3 pages).

(Continued)

*Primary Examiner* — Jonathan P Masinick
(74) *Attorney, Agent, or Firm* — CALFEE, HALTER & GRISWOLD LLP

(57) ABSTRACT

A latch assembly includes a latch body having a longitudinal wall portion extending from a front wall portion to a rear hinge portion, first and second latch members assembled with the longitudinal wall portion and laterally movable between an extended position and a retracted position, and a hinge bracket. The hinge bracket defines a mounting surface and is hingedly attached to the rear hinge portion of the latch body for angular adjustment of the latch body with respect to the mounting surface. When the latch body is oriented at a first angle, first and second mounting apertures in the front wall portion align with first and second mounting apertures in the hinge bracket, such that installation of mounting fasteners through the corresponding first and second mounting apertures of the front wall portion and the hinge bracket secures the latch body at the first angle.

20 Claims, 20 Drawing Sheets

(58) Field of Classification Search
CPC . E04F 11/1802; E04F 11/1804; E04F 11/181; E04F 11/1812; E04F 11/1817; E04F 11/1834; E04F 2011/1819; E04F 2011/1821; E04F 2011/1823; E04F 2011/1825; E04F 2011/1827
See application file for complete search history.

(56) References Cited

U.S. PATENT DOCUMENTS

| | | | | |
|---|---|---|---|---|
| 5,848,501 | A * | 12/1998 | Taipale | E04F 11/002 52/126.6 |
| 6,698,726 | B2 | 3/2004 | Platt | |
| 7,243,473 | B2 * | 7/2007 | Terrels | E04C 3/32 52/843 |
| 9,435,134 | B2 | 9/2016 | Walmsley | |
| 9,617,771 | B2 * | 4/2017 | Gill | E04G 5/145 |
| 10,287,776 | B2 * | 5/2019 | Dilio | E04F 11/1808 |
| 10,513,854 | B2 * | 12/2019 | Timmons | E04F 11/1834 |
| 10,612,734 | B2 * | 4/2020 | MacLeish | E04F 11/1836 |
| 10,625,329 | B2 * | 4/2020 | Avetsisiants | E04F 11/1842 |
| 11,268,285 | B2 * | 3/2022 | Léger | E04F 11/1817 |
| 2005/0218279 | A1 * | 10/2005 | Cicenas | E04F 21/00 248/219.1 |
| 2006/0175594 | A1 | 8/2006 | Burkart et al. | |
| 2009/0200532 | A1 | 8/2009 | Platt | |
| 2011/0073824 | A1 * | 3/2011 | Lappin | E04F 11/1836 29/428 |
| 2013/0136531 | A1 * | 5/2013 | Kobayashi | H02S 20/23 403/326 |
| 2015/0211235 | A1 * | 7/2015 | Sneith | E04F 11/1834 248/219.1 |
| 2015/0252570 | A1 * | 9/2015 | Springborn | E04H 17/1417 52/832 |
| 2017/0370121 | A1 | 12/2017 | Lindsay | |
| 2018/0179781 | A1 * | 6/2018 | Munro | E04F 11/1836 |
| 2019/0003187 | A1 * | 1/2019 | Goodman | E04F 11/1836 |

FOREIGN PATENT DOCUMENTS

| | | | | |
|---|---|---|---|---|
| CA | 2638709 | A1 * | 2/2010 | E04F 11/1836 |
| FR | 1478567 | A * | 4/1967 | |

OTHER PUBLICATIONS

International Search Report and Written Opinion from PCT/US21/45359 dated Jan. 19, 2022 (24 pages).

* cited by examiner

LATCHING RAILING ARRANGEMENT

CROSS-REFERENCE TO RELATED APPLICATION

This application claims priority to and all benefit of U.S. Provisional Patent Application Ser. No. 63/064,012, filed on Aug. 11, 2020, for LATCHING RAILING ARRANGEMENT, the entire disclosure of which is fully incorporated herein by reference.

BACKGROUND

Handrails and guardrails are commonly used for walkways, stairways, decks, and other locations to designate boundaries, provide steadying support for walkers, and prevent falls and other such accidents.

SUMMARY OF THE DISCLOSURE

In an exemplary embodiment of the present disclosure, a latch assembly includes a latch body having a longitudinal wall portion extending from a front wall portion to a rear hinge portion, first and second latch members assembled with the longitudinal wall portion and laterally movable between an extended position and a retracted position, and a hinge bracket. The hinge bracket defines a mounting surface and is hingedly attached to the rear hinge portion of the latch body for angular adjustment of the latch body with respect to the mounting surface. When the latch body is oriented at a first angle, first and second mounting apertures in the front wall portion align with first and second mounting apertures in the hinge bracket, such that installation of mounting fasteners through the corresponding first and second mounting apertures of the front wall portion and the hinge bracket secures the latch body at the first angle.

In another exemplary embodiment of the present disclosure, a rail is provided in combination with a latch assembly for attaching the rail to a support structure. The rail includes an elongated body portion, first and second side portions, and a cavity disposed between the first and second side portions. The latch assembly includes a latch body, first and second latch members, and a mounting bracket. The latch body is received in the rail cavity and includes a longitudinal wall portion extending to a rear portion. The first and second latch members are assembled with the longitudinal wall portion and laterally movable between an extended position in interlocking engagement with the first and second side portions of the rail and a retracted position disengaged from the first and second side portions of the rail. The mounting bracket is attached to the rear portion of the latch body and defines a mounting surface for mounting the latch body to the support structure.

In another exemplary embodiment of the present disclosure, a latch assembly includes a latch body having a longitudinal wall portion extending from a front wall portion to a rear portion, first and second latch members assembled with the longitudinal wall portion and laterally movable between an extended position and a retracted position, and a latch release mechanism comprises a user rotatable cam linked with the first and second latch members for sliding movement of the first and second latch members from the extended position to the retracted position.

In another exemplary embodiment of the present disclosure, a latch assembly includes a latch body having a longitudinal wall portion extending from a front wall portion to a rear portion, and a spring bracket assembled with the latch body and having first and second resilient tabs defining first and second latch members laterally movable between an extended position and a retracted position.

In another exemplary embodiment of the present disclosure, a latch assembly includes a body housing, a body block, and first and second latch members. The body housing includes first and second wall portions extending between first and second side edges. The body block is secured between the first and second wall portions of the body housing. The body block and the body housing together define first and second latch cavities extending to the first and second side edges of the body housing. The first and second latch members are retained in the first and second latch cavities and extend outward of the first and second side edges of the body housing. The first and second latch members include first and second latch release features operable for retraction of the first and second latch members into the first and second latch cavities.

In another exemplary embodiment of the present disclosure, a support structure is provided in combination with a latch assembly for attaching a rail to the support structure. The latch assembly includes a latch body and first and second latch members. The latch body includes upper and lower wall portions extending between first and second ends and a rear wall portion mounted to an outer surface of the support structure. The latch body defines first and second latch cavities extending to the first and second ends. The first and second latch members are retained in the first and second latch cavities and extend outward of the first and second ends of the latch body. The first and second latch members include first and second latch release features operable for retraction of the first and second latch members into the first and second latch cavities.

In another exemplary embodiment of the present disclosure, a rail including an elongated body portion and first and second side portions is provided in combination with a latch assembly for attaching the rail to a support structure. The latch assembly includes a latch body and first and second latch members. The latch body is received in a cavity in the rail between the first and second side portions, and includes upper and lower wall portions extending between first and second ends, with the latch body defining first and second latch cavities extending to the first and second ends. The first and second latch members are retained in the first and second latch cavities and extend outward of the first and second ends of the latch body and into interlocking engagement with the first and second side portions of the rail. The first and second latch members include first and second latch release features operable for retraction of the first and second latch members into the first and second latch cavities to disengage the first and second latch members from the first and second side portions of the rail.

In another exemplary embodiment of the present disclosure, a rail system includes a support structure, a rail including an elongated body portion and first and second side portions, and a latch assembly. The latch assembly includes a latch body and first and second latch members. The latch body is received in a cavity in the rail between the first and second side portions, and includes upper and lower wall portions extending between first and second ends and a rear wall portion mounted to an outer surface of the support structure, with the latch body defining first and second latch cavities extending to the first and second ends. The first and second latch members are retained in the first and second latch cavities and extend outward of the first and second ends of the latch body and into interlocking engagement with the first and second side portions of the rail. The first and second latch members include first and second latch release features operable for retraction of the first and second latch members into the first and second latch cavities to disengage the first and second latch members from the first and second side portions of the rail.

In another exemplary embodiment of the present disclosure, a rail system includes a support structure, upper and lower rails, upper and lower latch assemblies, and at least one barrier element. The upper rail includes an elongated body portion, first and second side portions together defining an upper cavity, and a bottom wall defining at least one upper aperture. The upper latch assembly is mounted to the support structure and received in the upper cavity to releasably latch the upper rail to the support structure. The lower rail includes an elongated body portion and first and second side portions together defining a lower cavity, an upper wall defining at least one lower aperture, and a base wall between the upper wall and the lower cavity. The lower latch assembly is mounted to the support structure and is received in the lower cavity to releasably latch the lower rail to the support structure. The at least one barrier element has a lower end received through the at least one lower aperture and supported by the base wall, and an upper end received through the at least one upper aperture.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes exemplary embodiments and is not intended to limit the scope of the claims in any way. Indeed, the invention as claimed is broader than and unlimited by the described embodiments, and the terms used have their full ordinary meaning.

The present disclosure contemplates arrangements for attaching a portion of an elongated component (e.g., handrail or other such rail-shaped component) to a support structure (e.g., a post or wall). According to an aspect of the present disclosure, one or more latching arrangements may be used to attach a rail to a support structure, for example, to provide for attachment without field installation of fasteners between the rail and the support structure. In some applications, such an arrangement may reduce installation and/or disassembly time or effort while providing for a robust, weight-bearing attachment.

Figure 1:
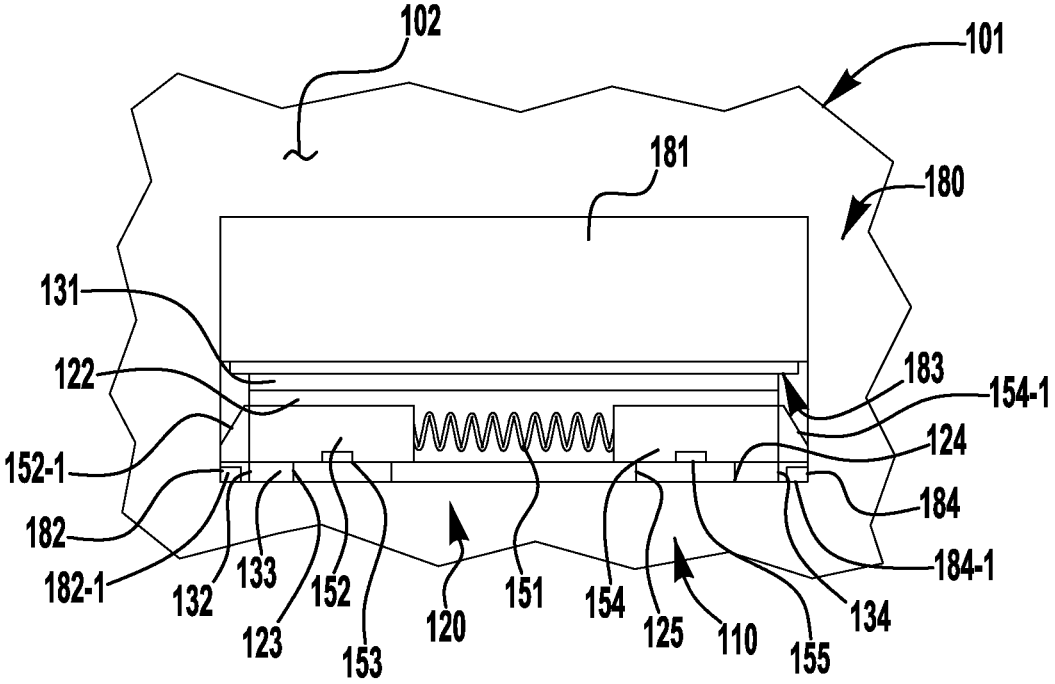
FIG. 1 is a schematic front view of a latching arrangement for attaching a rail to a support structure, according to an exemplary embodiment of the present disclosure.
Figure 2:
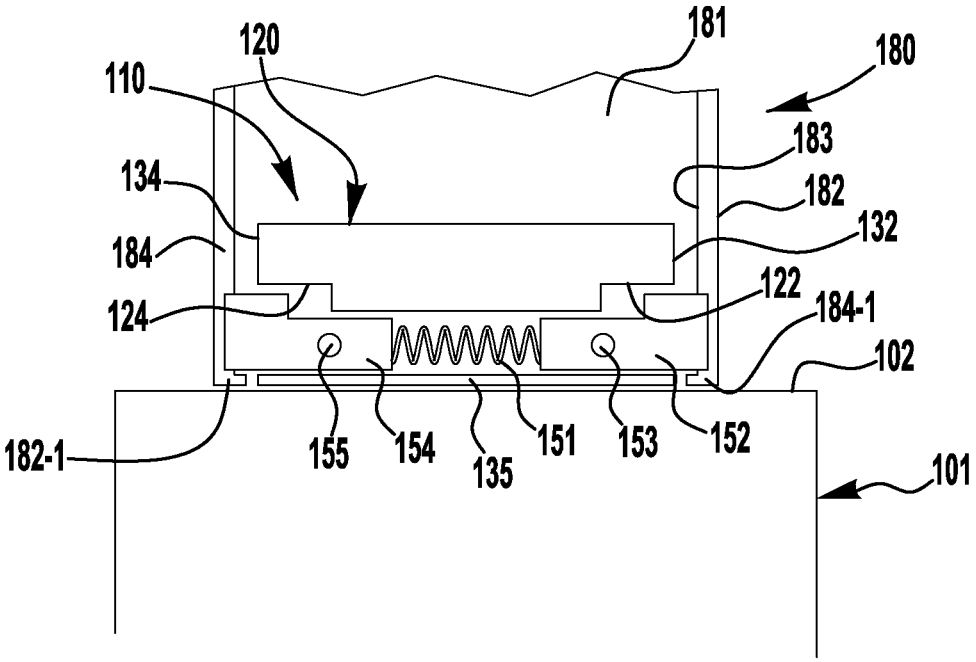
FIG. 2 is a schematic top view of the latching arrangement of FIG. 1.
Figure 3:
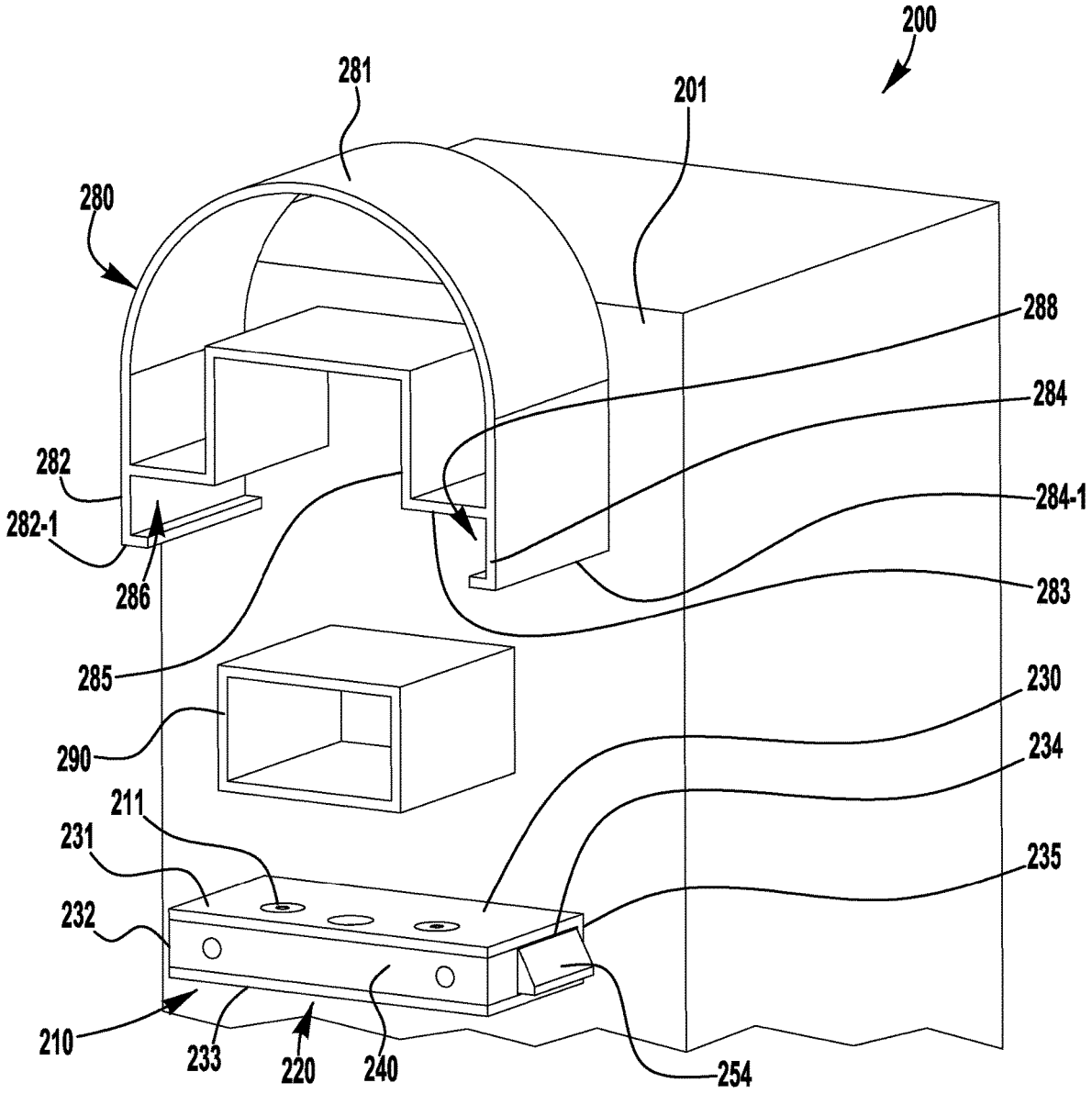
FIG. 3 is a perspective exploded view of a railing system, according to an exemplary embodiment of the present disclosure, with the rail portions truncated for clearer illustration of the system.
Figure 4:
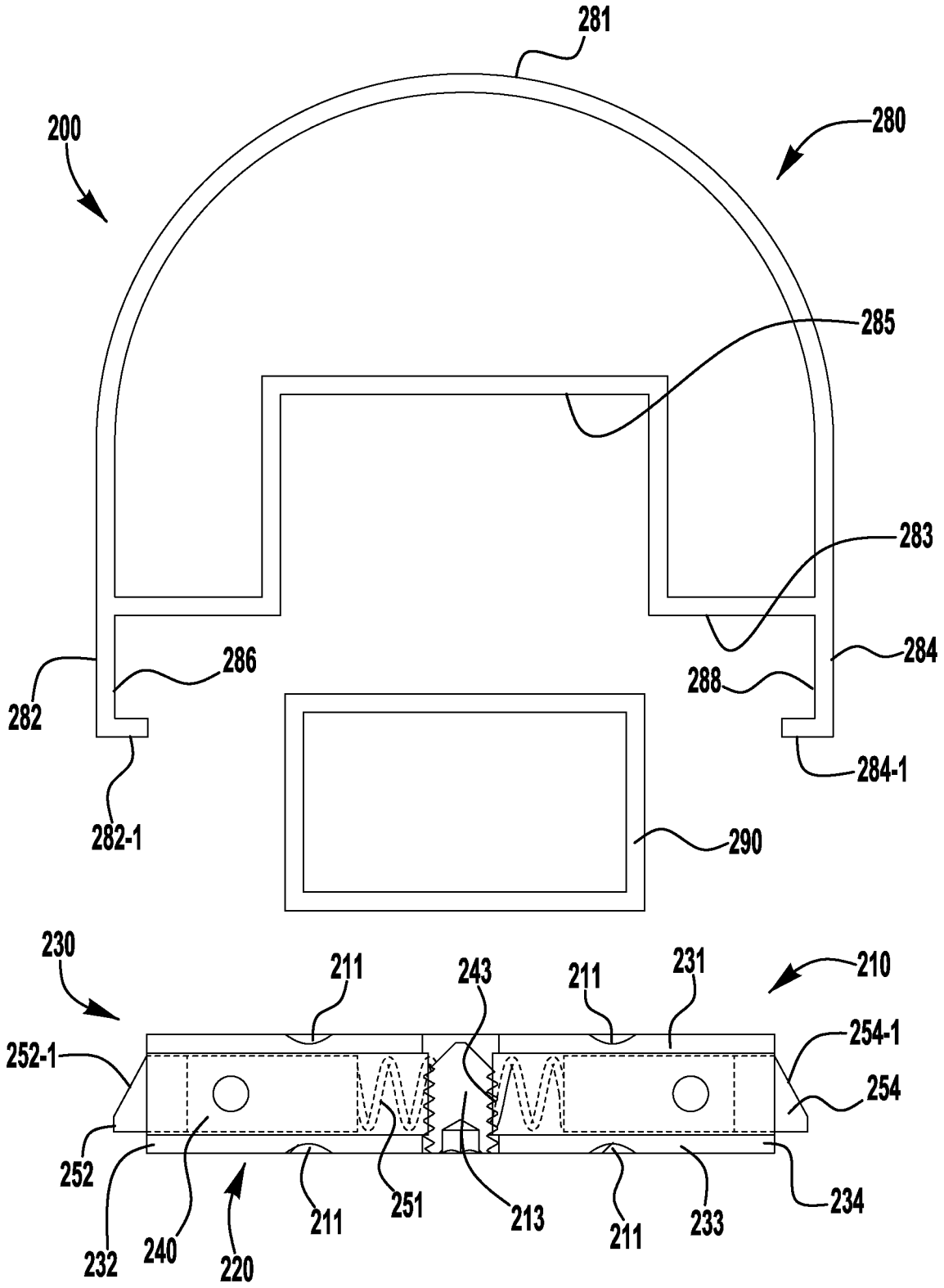
FIG. 4 is a front exploded view of the rail and latch assembly of the railing system of FIG. 3.
Figure 5:
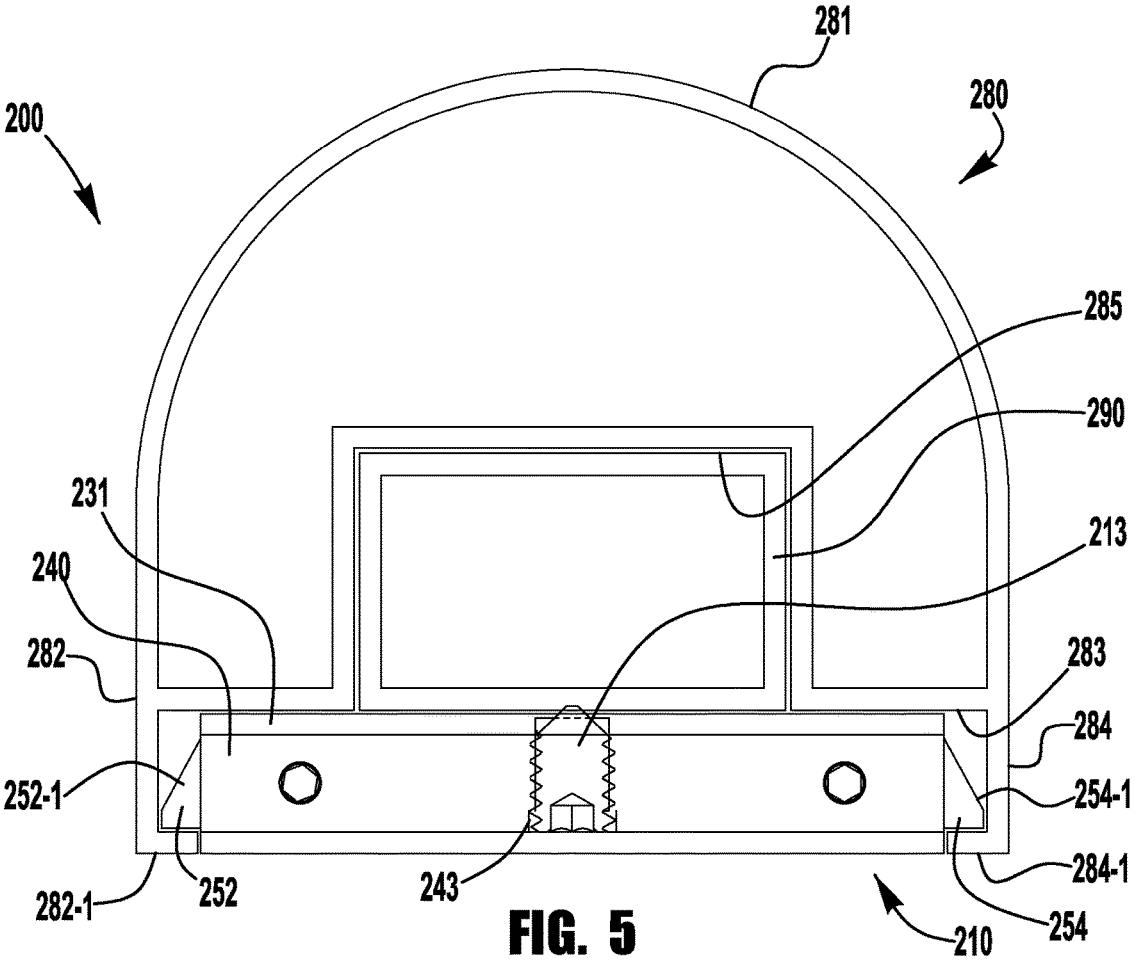
FIG. 5 is a front assembled view of the rail and latch assembly of the railing system of FIG. 3.

FIGS. 1 and 2 schematically illustrate an exemplary latch assembly 110 mountable to a post or other such support structure 101 for latching attachment of a rail 180 (e.g., a first end of the rail) to the support structure. The rail 180 includes an elongated body portion 181 and first and second side portions 182, 184, which may extend from the body portion to define a rail cavity 183 for receiving the latch assembly 110. Although not shown, it is understood that a second end of the rail may be attached to a second support structure by a second latch assembly mounted to the second support structure.

The exemplary latch assembly 110 includes a latch body 120 having longitudinal upper and lower wall portions 131, 133 (FIG. 1) extending between first and second ends 132, 134, and a rear wall portion 135 mountable (e.g., using fasteners, welding, and/or any other suitable arrangements) to an outer surface 102 of the support structure 101. The latch body 120 defines first and second latch cavities 122, 124 extending to the first and second ends 132, 134. First and second latch members 152, 154 are retained in the first and second latch cavities 122, 124 and extend outward of the first and second ends 132, 134 of the latch body 120 and into interlocking engagement with the first and second side portions 182, 184 of the rail member 180 when the latch assembly 110 is received in the rail cavity 183.

The first and second latch members 152, 154 are retractable into the latch cavities 122, 124 to disengage the rail member 180 from the latch assembly 110, for separation of the rail member from the support structure 101. To provide for user retraction of the latch members 152, 154, the latch members are provided with latch release features (shown schematically at 153, 155) operable (e.g., engageable with a tool or a user's fingers) for sliding movement of the latch members. The latch release features 153, 155 may include a variety of structures, including, for example, user engageable holes or projections accessible through and/or extending through slotted portions 123, 125 (e.g., separate openings or portions of the same opening) in the latch body 120. While the latch members 152, 154 may also be manually movable from the retracted position to the extended position (e.g., by user operation of the latch release features), in other embodiments, the latch members 152, 154 may be spring biased to the extended position, for example, by one or more coil springs 151 or other such spring member(s) disposed in the latch body 120. The latch members 152, 154 may be provided with chamfered end portions 152-1, 154-1 contoured such when the latch assembly 110 is inserted into the rail cavity 183, end portions 182-1, 184-1 of the rail side portions 182, 184 engage the chamfered end portions 152-1, 154-1 of the latch members to force the latch members against the spring biasing forces to slide the latch members to the retracted position. When the latch assembly 110 is fully installed in the rail cavity 183, the spring biasing forces return the latch members 152, 154 to the extended position for interlocking engagement with the rail side portions 182, 184. The rail side portions may include a variety of latch interlocking structures, including, for example, flanges, recesses, detents and apertures.

FIGS. 3-8 illustrate an exemplary railing system 200 including a latch assembly 210 mountable to a post or other such support structure 201 for latching attachment of a rail 280 (shown truncated to more clearly show all system components) to the support structure. The exemplary rail 280 includes an elongated body portion 281 and first and second side portions 282, 284, which may extend from the body portion to define a rail cavity 283 for receiving the latch assembly 210. Although not shown, it is understood that a second end of the rail 280 may be attached to a second support structure by a second latch assembly mounted to the second support structure.

First and second latch members 252, 254 extend from the lateral ends 232, 234 of the latch body housing 230 for interlocking engagement with inward facing first and second side channels 286, 288 defined by inward facing flanges 282-1, 284-1 of the rail side portions 282, 284. The side channels may extend the entire length of the rail, or may be limited to locations at which latched attachment may be desired.

While the rail may be provided as a single piece component, in the illustrated embodiment, an inner rail member 290 is received in a central channel 285 of an outer rail member 280 and is captured between the outer rail member and the latch assembly 210 when the outer rail member is secured to the latch assembly. This separate inner rail member 290 may provide for use of the rail in a variety of railing systems, including, for example, use with panel or spaced baluster barriers, by providing corresponding apertures in the inner rail member, as described in greater detail below.

The exemplary latch assembly 210 includes a latch body 220 formed from a U-shaped body housing 230 (e.g., U-shaped bracket) and a body block 240. The body housing 230 includes upper and lower longitudinal wall portions 231, 233 extending between first and second ends or side edges 232, 234, and a rear wall portion 235 extending between the upper and lower wall portions. The body block 240 is secured between the longitudinal wall portions 231, 233 (e.g., by screws or other such fasteners 211), and includes cutouts 242, 244 that, combined with the body housing 230, define first and second latch cavities 222, 224 (FIG. 6) that extend to the first and second side edges 232, 234.

Figure 6:
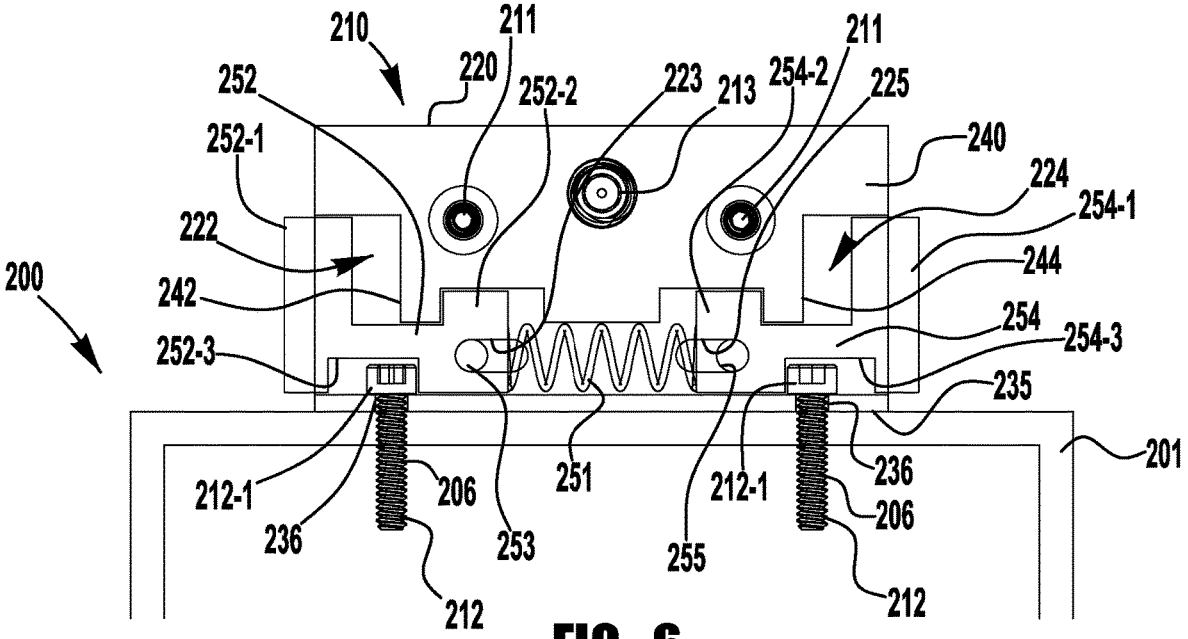
FIG. 6 is a bottom view of the latch assembly and support structure of the railing system of FIG. 3.
Figure 7:
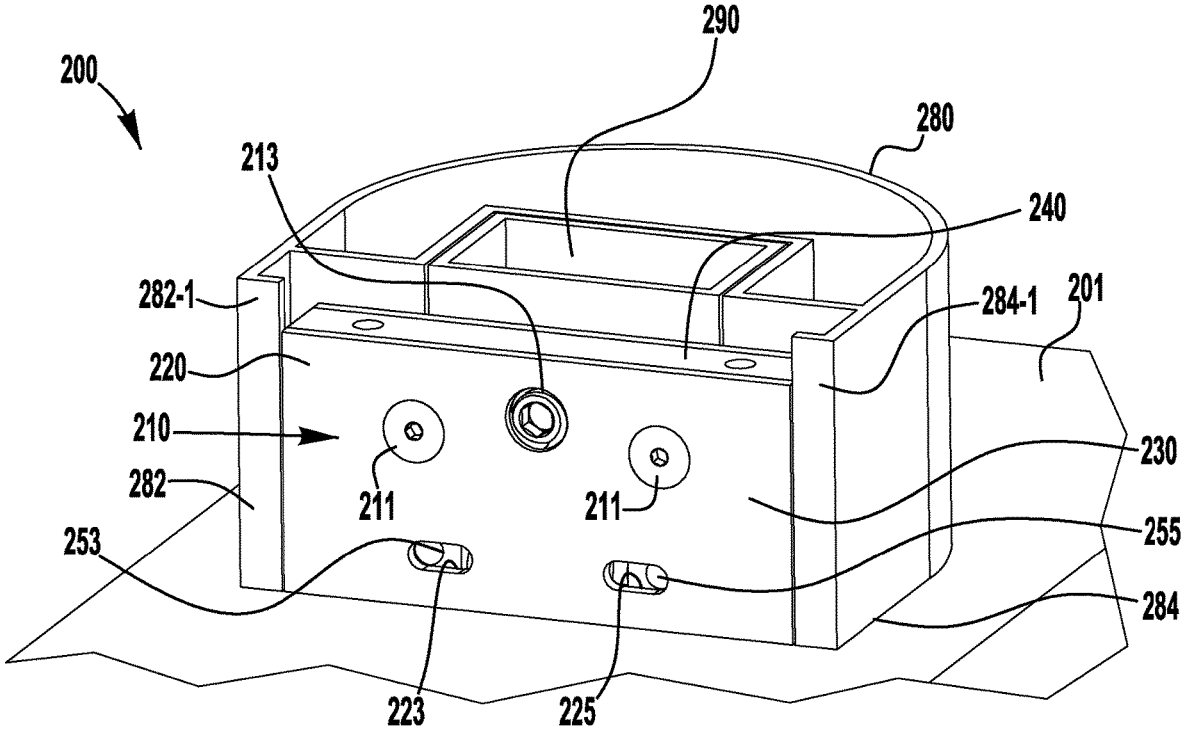
FIG. 7 is a bottom perspective view of the railing system of FIG. 3.
Figure 8:
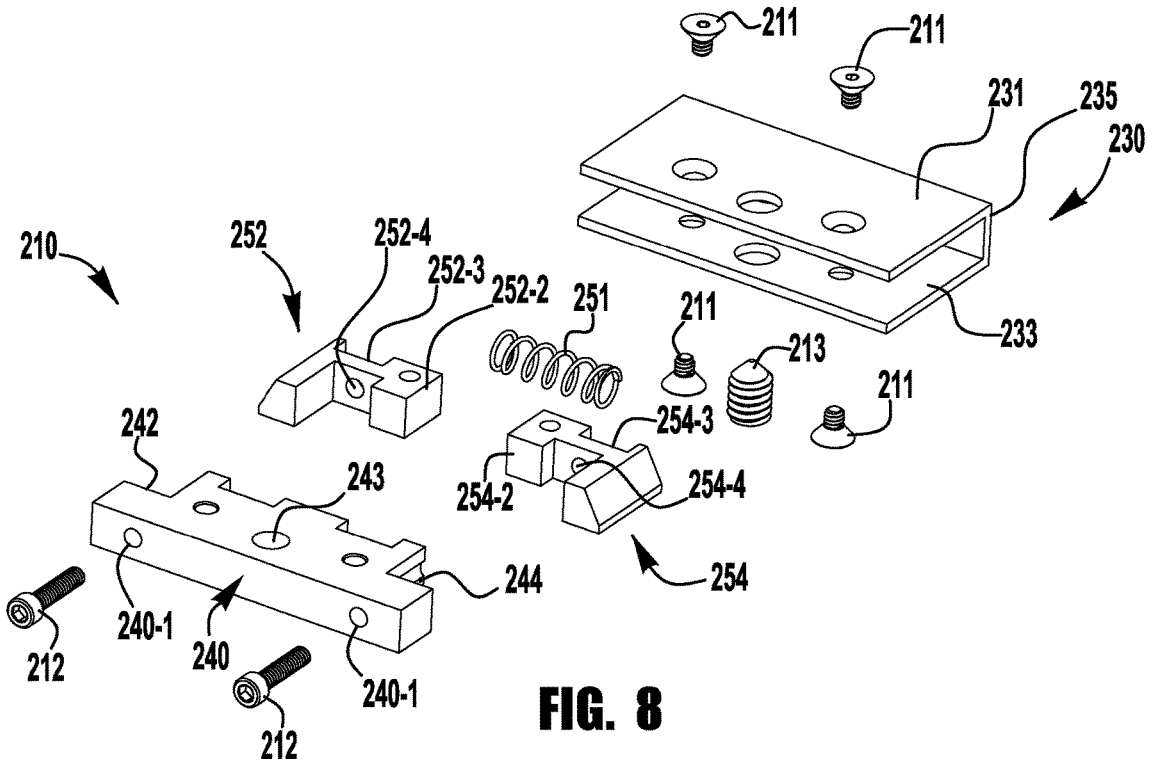
FIG. 8 is an exploded perspective view of the latch assembly of FIG. 3.

To mount the exemplary latch assembly 210 to the support structure, fasteners 212 are inserted through pass-through holes 240-4, 252-4, 254-4 in the body block 240 and in the latch members 252, 254 (FIG. 8) for installation through mounting holes 236, 206 in the body housing rear wall portion 235 and support structure 201, as shown in FIG. 6. Cutouts 252*c*, 254*c* in the latch members 252, 254 receive head portions 212*c* of the fasteners 212 to accommodate lateral sliding movement of the latch members with respect to the fastened latch body.

The latch members 252, 254 are retained in the first and second latch cavities 222, 224 and are laterally slideable between an extended position in which end portions 252-1, 254-1 extend outward of the body housing side edges 232, 234, and a retracted position, in which the latch members 252, 254 are fully received within the latch cavities, thereby disengaging from the rail side portions 282, 284. The exemplary latch members 252, 254 include an inner lateral foot portion 252-2, 254-2 retained in inner recesses of the latch cavities 222, 224, which may be sized to define lateral limit positions of the latch members.

To provide for user retraction of the latch members 252, 254, the latch members are provided with latch release features for sliding movement of the latch members. While a variety of structures may be used, in the illustrated embodiment, the latch members 252, 254 include tool engagement holes 253, 255 accessible through slotted portions 223, 225 (e.g., separate openings or portions of the same opening) in the latch body 220 (e.g., in the lower body housing wall 233). To detach the rail 280 from the latch assembly 210, screwdrivers, pliers, or other such tools (not shown) may be inserted into the tool engagement holes 253, 255 and manipulated to retract the latch members 252, 254 into the latch body 220 and out of engagement with the rail side portions 282, 284.

The exemplary latch members 252, 254 are spring biased to the extended position by a coil spring 251 or other such spring member(s) disposed in the latch body 220 between the foot portions 252-2, 254-2 of the latch members. The exemplary latch members 252, 254 are provided with chamfered end portions 252-1, 254-1 contoured such when the latch assembly 210 is inserted into the rail cavity 283, flanged end portions 282-1, 284-1 of the rail side portions 282, 284 engage the chamfered end portions 252-1, 254-1 of the latch members to force the latch members against the spring biasing forces to slide the latch members to the retracted position. When the latch assembly 210 is fully installed in the rail cavity 283, the coil spring 251 forces the latch members 252, 254 laterally outward to the extended position for interlocking engagement of the latch end portions 252-1, 254-1 with the rail side portions 282, 284.

To rigidly secure the rail 280 to the latch assembly 210, the latch assembly may be provided with one or more set screws 213 or other fasteners, installed in a threaded hole 243 in the body block 240, that may be tightened into clamping engagement with the rail (e.g., with the inner rail member 290, as shown). In other embodiments (not shown), one or more fasteners may be installed through aligned mounting holes in the latch body and rail for more secure attachment of the rail to the support structure.

Figure 9:
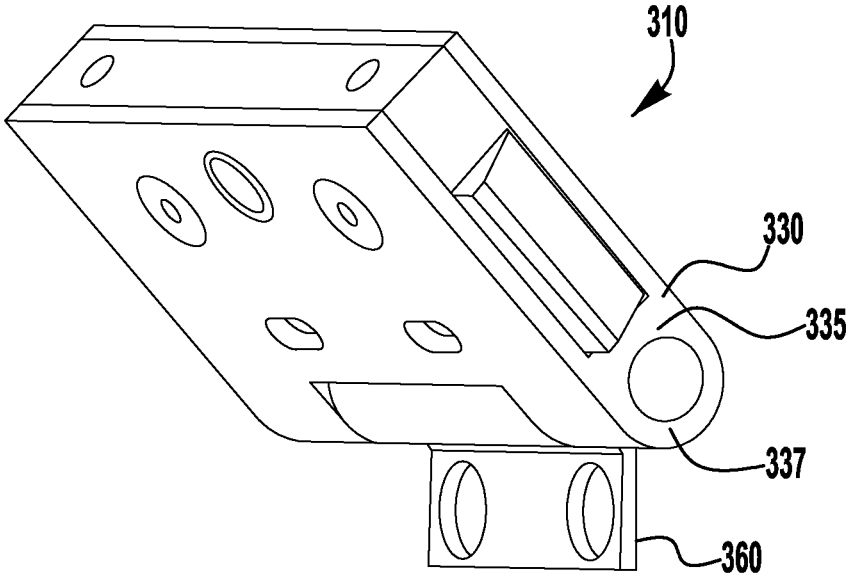
FIG. 9 is a perspective view of a hinged latch assembly for attaching a rail to a support structure at a range of angled orientations, according to an exemplary embodiment of the present disclosure.
Figure 10:
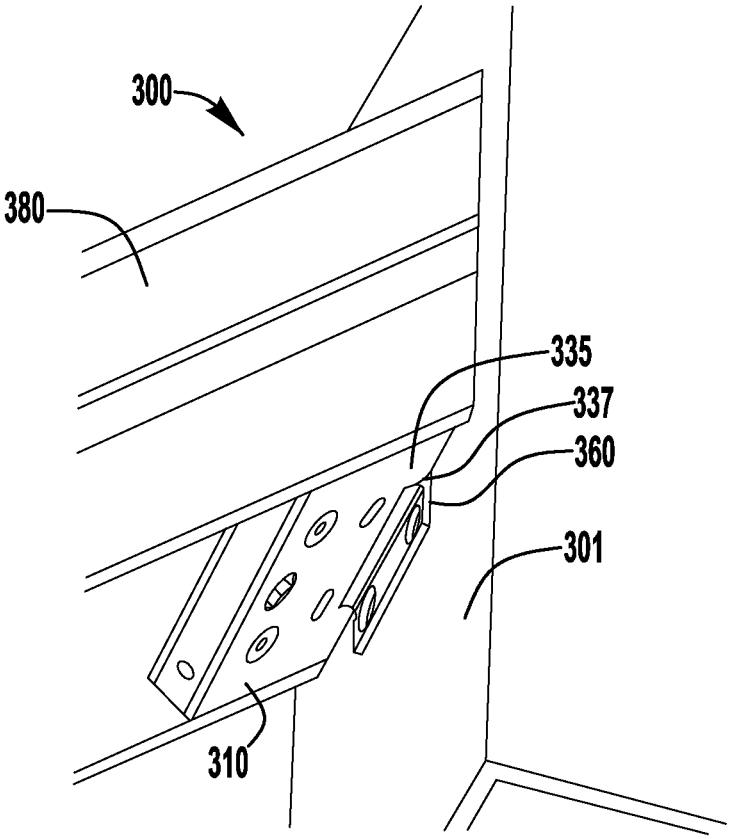
FIG. 10 is a perspective view of the hinged latch assembly of FIG. 9 mounted to a support structure.

According to another aspect of the present disclosure, to allow for providing rails at an angle with respect to the support structure (e.g., for use with a stairway, or for smaller vertical deviations in the rail attachment points), the latch assembly body may be provided with a hinge bracket mountable to the support structure and secured to the latch body by a hinge portion. FIGS. 9 and 10 illustrates a railing system 300 including an exemplary latch assembly 310, similar to the latch assembly 210 of FIGS. 3-8, including a U-shaped body housing 330 having a rear wall 335 defining an apertured hinge portion 337 pivotably attached (e.g., by a hinge pin, not shown) to a hinge bracket 360 that is mountable to a support structure 301, as shown in FIG. 10. As shown, the end of the attached rail 380 may by cut at an angle to accommodate the desired angular orientation.

In another embodiment, a latch assembly may be provided with a modular latch body housing configured for selective assembly with one or more mounting blocks for mounting a latched rail in a level (i.e., horizontal) configuration, or with a hinged bracket for mounting a latched rail in an angled (e.g., inclined stairway rail) configuration. FIGS. 11A-12E illustrate an exemplary latch assembly 410 similar to the latch assemblies 210, 310 of FIGS. 3-10 (with similar components numbered accordingly) having a modular latch body housing 430 that can be assembled with mounting blocks **460*a*-1, 460*a*-2 (FIGS. 11A-11D) for mounting a latched rail in a level (i.e., horizontal) configuration (FIGS. 11D-11F), or with a hinged bracket 460*b* (FIGS. 12A-12D) for mounting a latched rail in an angled (e.g., inclined stairway rail) configuration (FIGS. 12D-12E**).

The exemplary latch assembly 410 includes a latch body 420 formed from a generally U-shaped body housing 430 and a body block 440. The body housing 430 includes upper and lower longitudinal wall portions 431, 433 extending between first and second ends or side edges 432, 434, and a rear wall portion 435 extending between the upper and lower wall portions. The body block 440 is secured between the upper and lower wall portions 431, 433 (e.g., by screws or other such fasteners 411), and includes cutouts 442, 444 that, combined with the body housing 430, define first and second latch cavities 422, 324 that extend to the first and second side edges 432, 434.

First and second latch members 452, 454 extend from the lateral side edges 432, 434 of the body housing 430 for interlocking engagement with inward facing first and second side channels 486, 488 defined by inward facing flanges 482-1, 484-1 of the rail side portions 482, 484 of the outer rail member 480. The side channels may extend the entire length of the rail, or may be limited to locations at which latched attachment may be desired.

The rear wall portion 435 of the body housing 430 includes outer notched portions 438 and a central apertured portion 437 including through bore 439 to permit attachment of mounting blocks **460*a*-1, 460*a*-2 to the body housing for level mounting. The mounting blocks 460*a*-1, 460*a*-2 include lower leg portions 461*a*-1, 461*a*-2 received in and interlocking with the notched portions 438 and including apertures 462*a*-1, 462*a*-2 that align with the through bore 439 to receive a laterally extending retaining fastener 463, and upper side walls 464*a*-1, 464*a*-2 having bores 465*a*-1, 465*a*-2 that align with apertures 436-1, 436-2 in upper side walls 431-1, 431-2 of the body housing upper wall portion 431. To mount the exemplary latch assembly 410*a* to a support structure, elongated fasteners 466*a* are installed through the aligned bores 465*a*-1, 465*a*-2 and apertures 436-1, 436-2 for installation through mounting holes in the support structure 401**.

The exemplary upper side walls **464*a*-1, 464*a*-2, 431-1, 431-2 in the mounting blocks 460*a*-1, 460*a*-2 and body housing 430 define a central channel 415, which may be sized to receive an inner rail member 490 protruding from a central channel 485 of the outer rail member 480, such that the inner rail member is captured between the outer rail member and the latch assembly 410*a*** when the outer rail member is secured to the latch assembly.

The exemplary latch members 452, 454 are spring biased to the extended position by a coil spring 451 or other such spring member(s) disposed in the latch body 420 between foot portions 452-2, 454-2 of the latch members. The exemplary latch members 452, 454 are provided with chamfered end portions 452-1, 454-1 contoured such when the latch assembly 410 is inserted into the rail cavity 483, flanged end portions of the rail side portions 482, 484 engage the chamfered end portions of the latch members to force the latch members against the spring biasing forces to slide the latch members to the retracted position. When the latch assembly 410 is fully installed in the rail cavity, the coil spring 451 forces the latch members 452, 454 laterally outward to the extended position for interlocking engagement of the latch end portions 452-1, 454-1 with the rail side portions.

To provide for user retraction of the latch members 452, 454, the latch members are provided with latch release features for sliding movement of the latch members. While a variety of structures may be used, in the illustrated embodiment, the latch members 452, 454 include tool engagement portions (e.g., holes 453, 455) accessible through slotted portions 423, 425 (e.g., separate openings or portions of the same opening) in the latch body 420 (e.g., in the lower body housing wall 433). To detach the railing from the latch assembly 410, screwdrivers, pliers, or other such tools may be inserted into the tool engagement holes 453, 455 and manipulated to retract the latch members 452, 454 into the latch body 420 and out of engagement with the rail side portions.

Figure 11A:
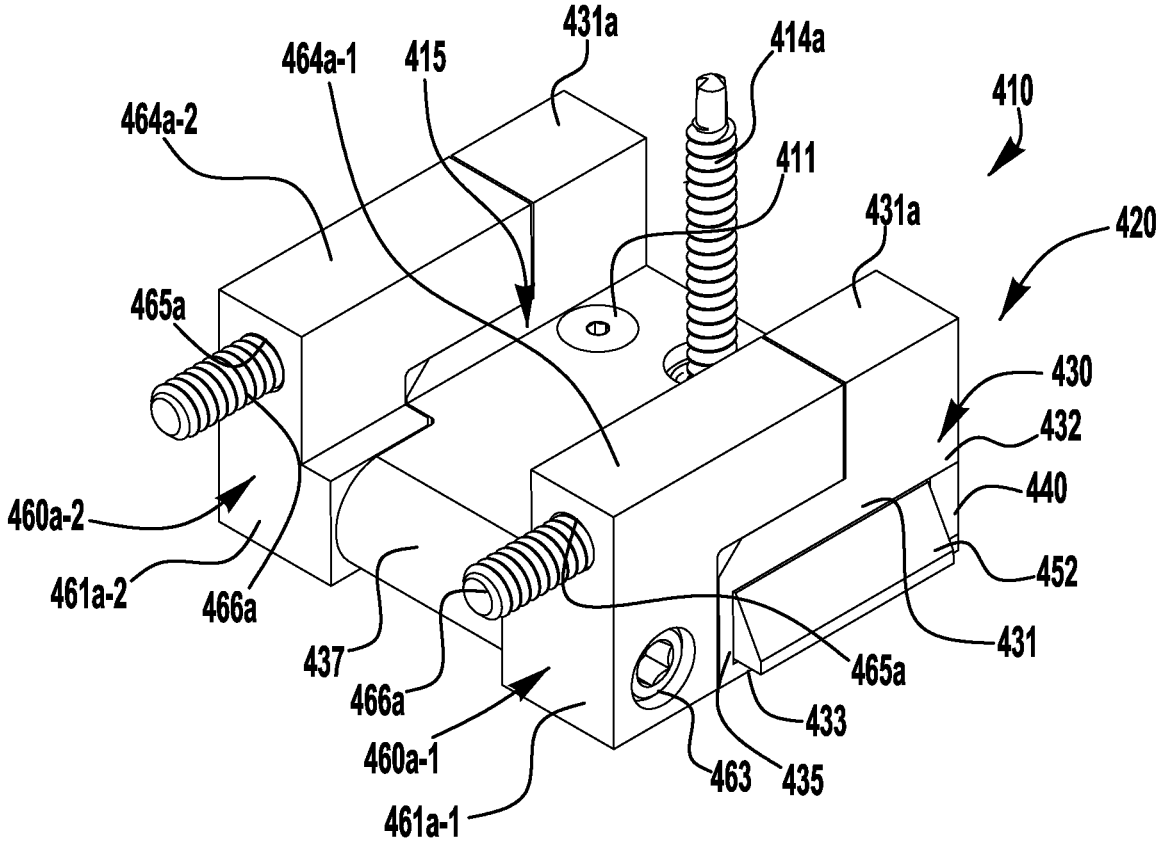
FIG. 11A is a rear perspective view of a latch assembly having mounting blocks for mounting a latched rail in a level configuration.
Figure 11B:
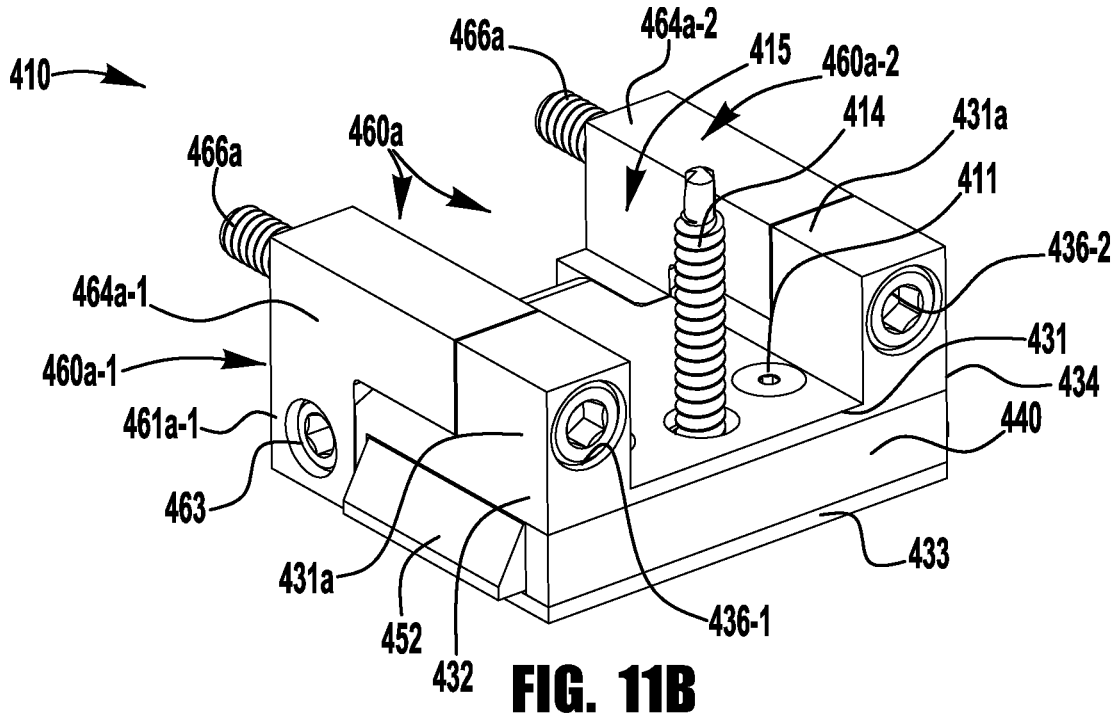
FIG. 11B is a front perspective view of the latch assembly of FIG. 11A.
Figure 11C:
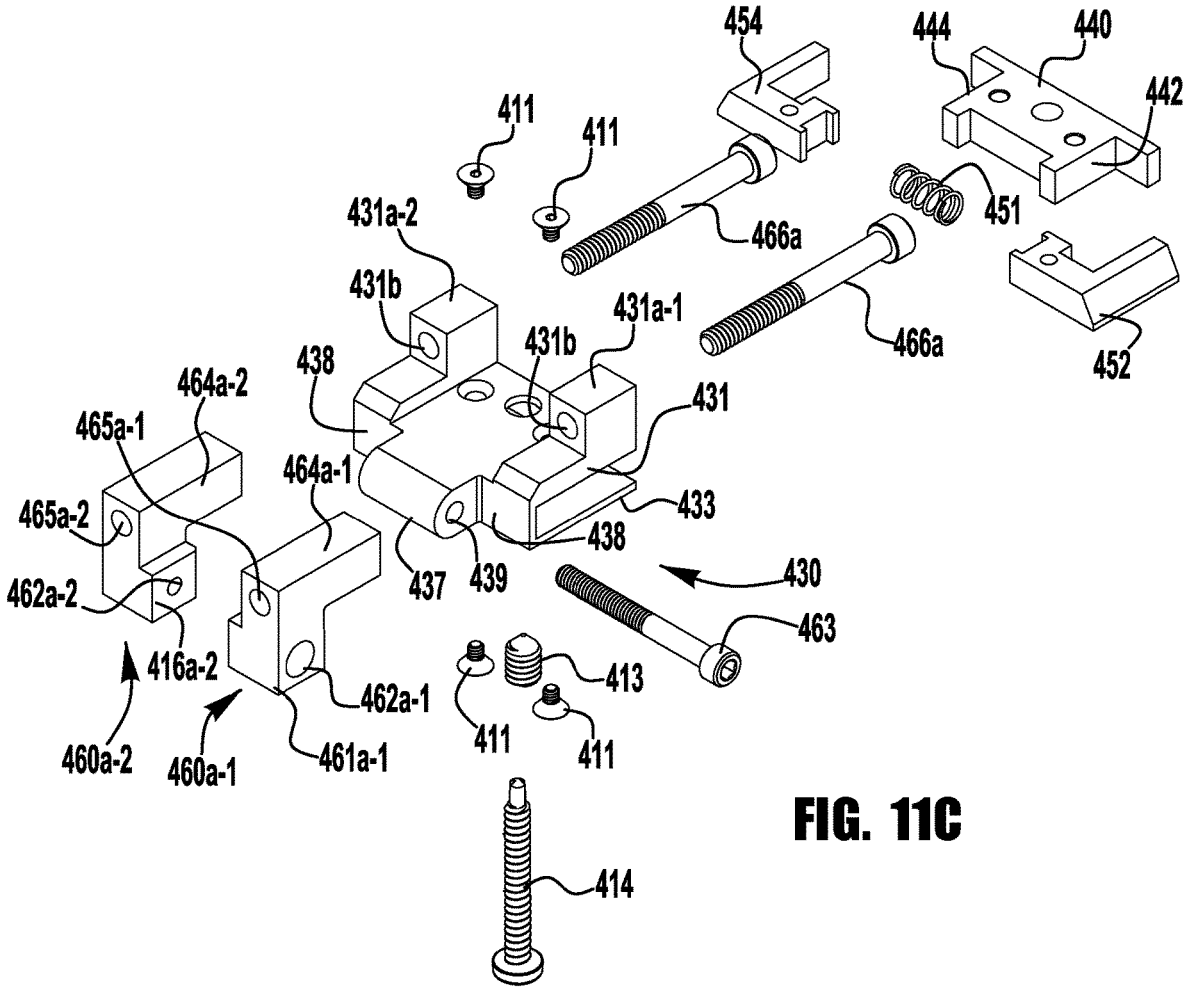
FIG. 11C is an exploded perspective view of the latch assembly of FIG. 11A.
Figure 11D:
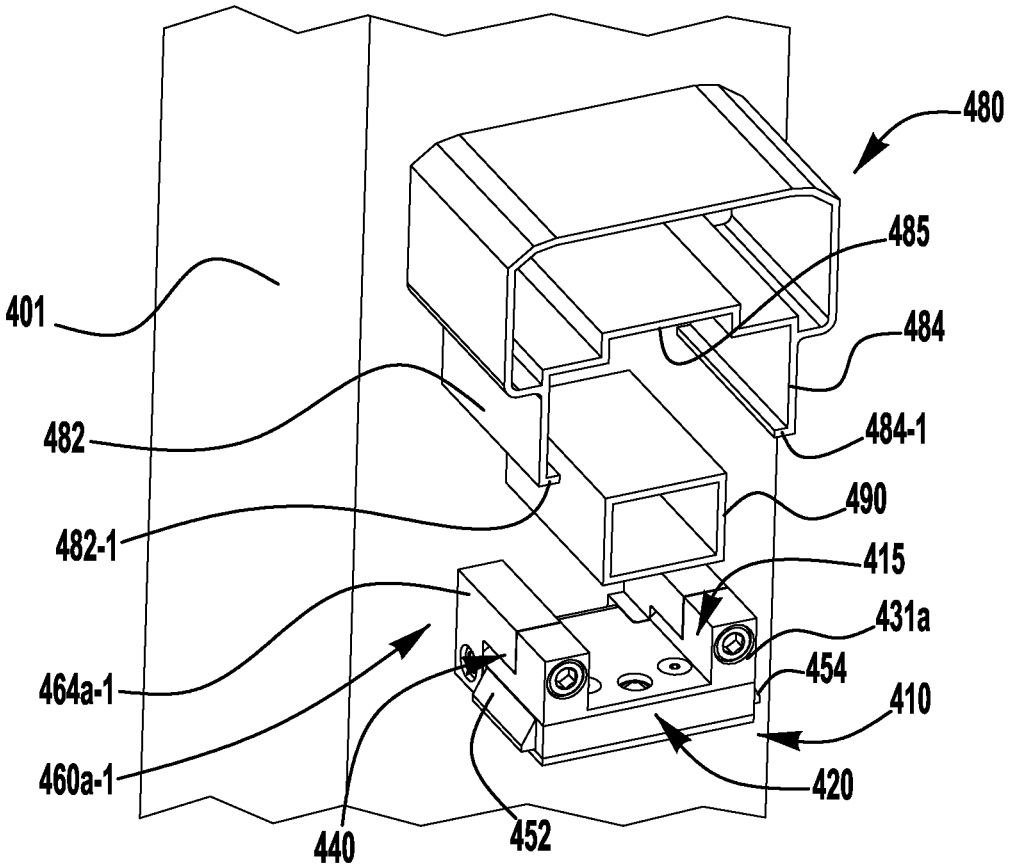
FIG. 11D is a perspective view of the latch assembly of FIG. 11A, shown horizontally mounted with a support structure prior to attachment with inner and outer rail members.
Figure 11E:
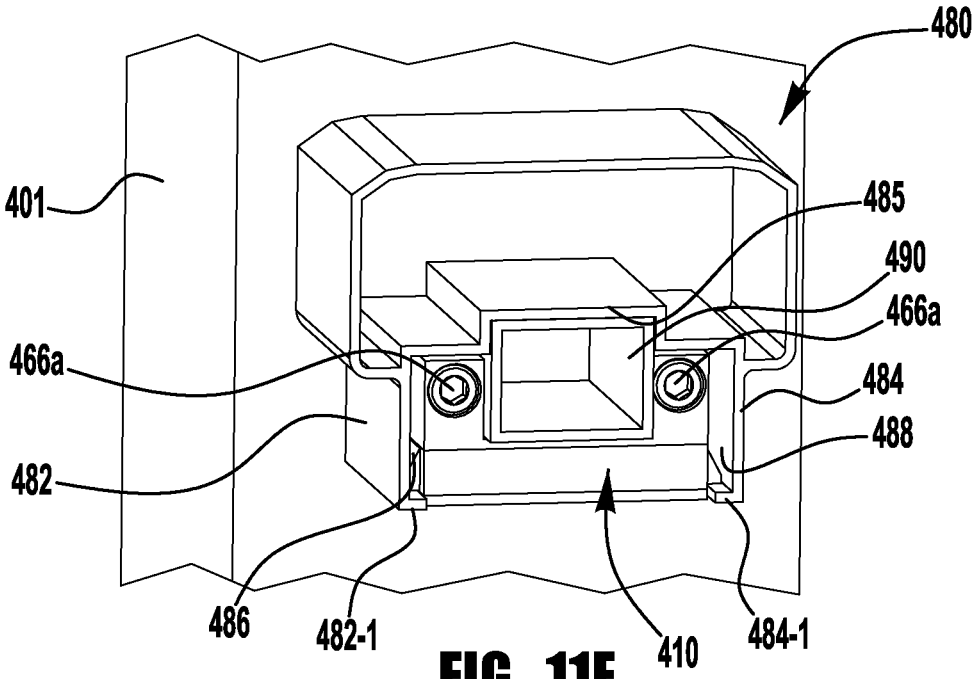
FIG. 11E is a perspective view of the latch assembly, support structure and inner and outer rail members of FIG. 11D, shown with the latch assembly attached with the inner and outer rail members.
Figure 11F:
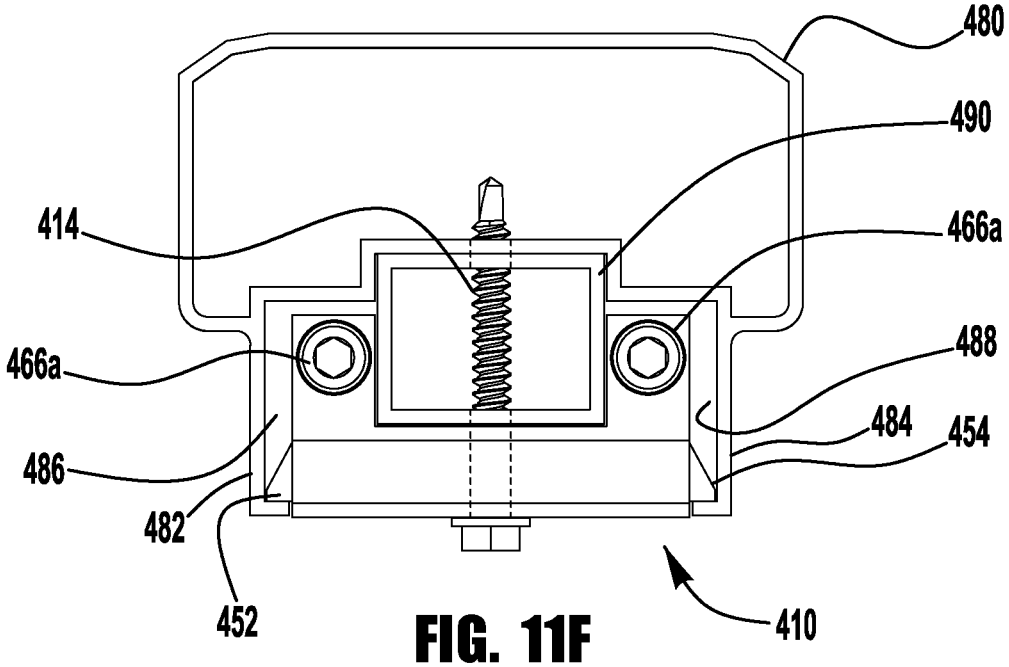
FIG. 11F is a front elevational view of the latch assembly, support structure and inner and outer rail members of FIG. 11D, shown in an assembled condition.

To more rigidly secure the outer rail member 480 to the latch assembly 410*a*, the latch assembly may be provided with a fastener 414 that may be installed through aligned mounting holes in the latch body and rail for more secure attachment of the rail to the support structure (FIG. 11F). Alternatively, a set screw 413 (FIG. 11C) may be installed in a threaded hole in the body block 440 and tightened into clamping engagement with the rail (e.g., with the inner rail member 490, as shown).

Figure 12A:
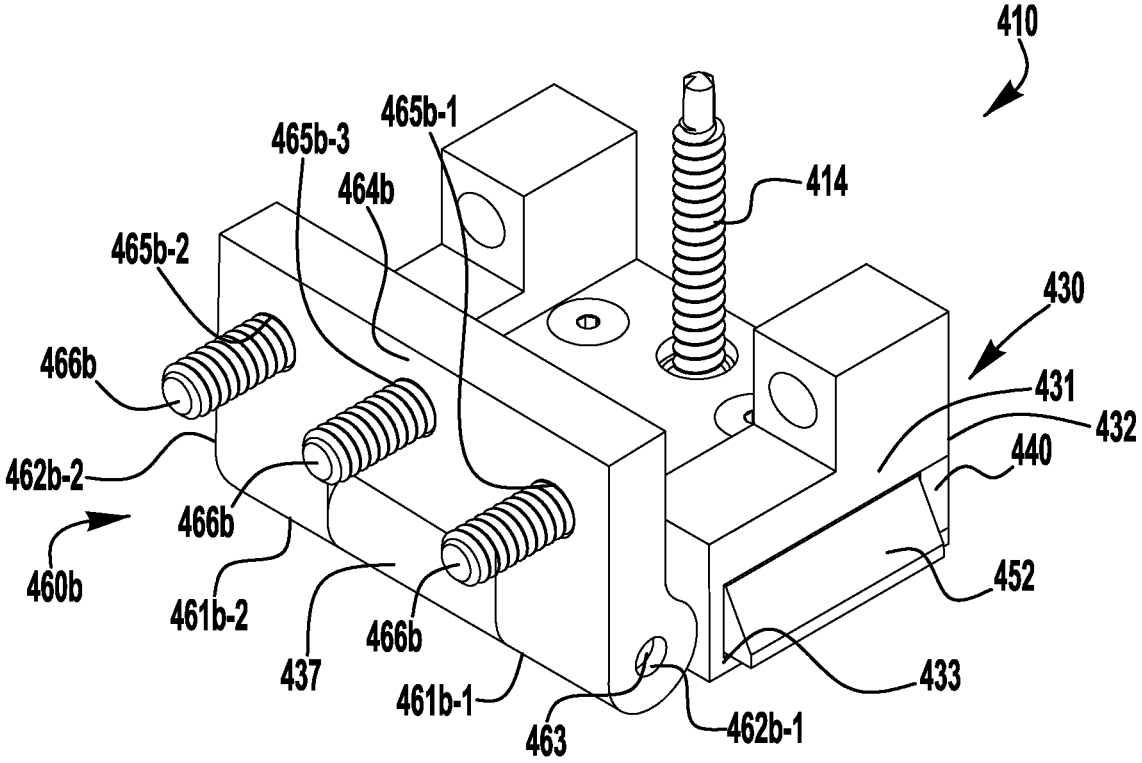
FIG. 12A is a rear perspective view of the latch assembly of FIG. 11A, with the mounting blocks replaced with a hinge bracket for mounting a latched rail in an angled configuration.
Figure 12B:
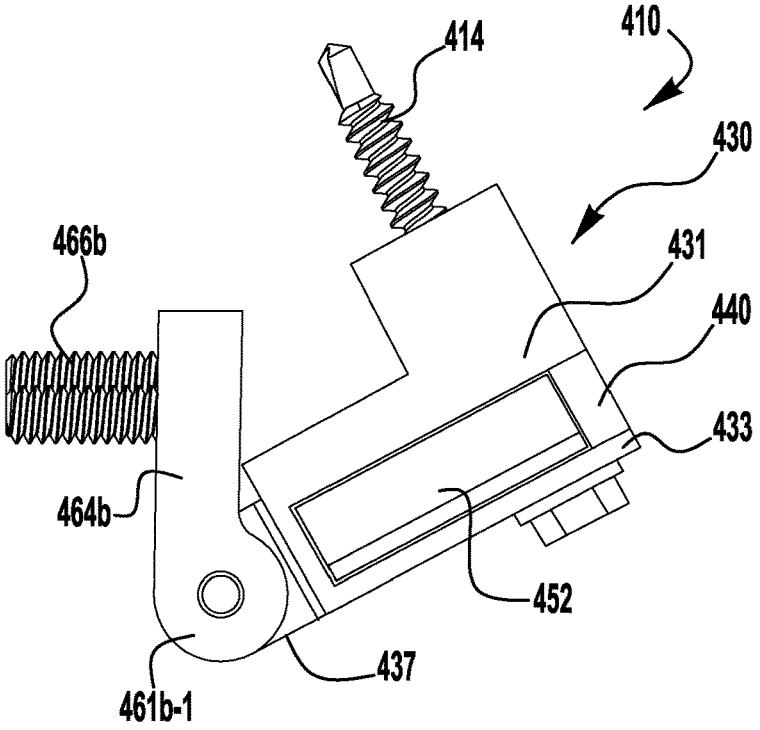
FIG. 12B is a side view of the latch assembly of FIG. 12A.
Figure 12C:
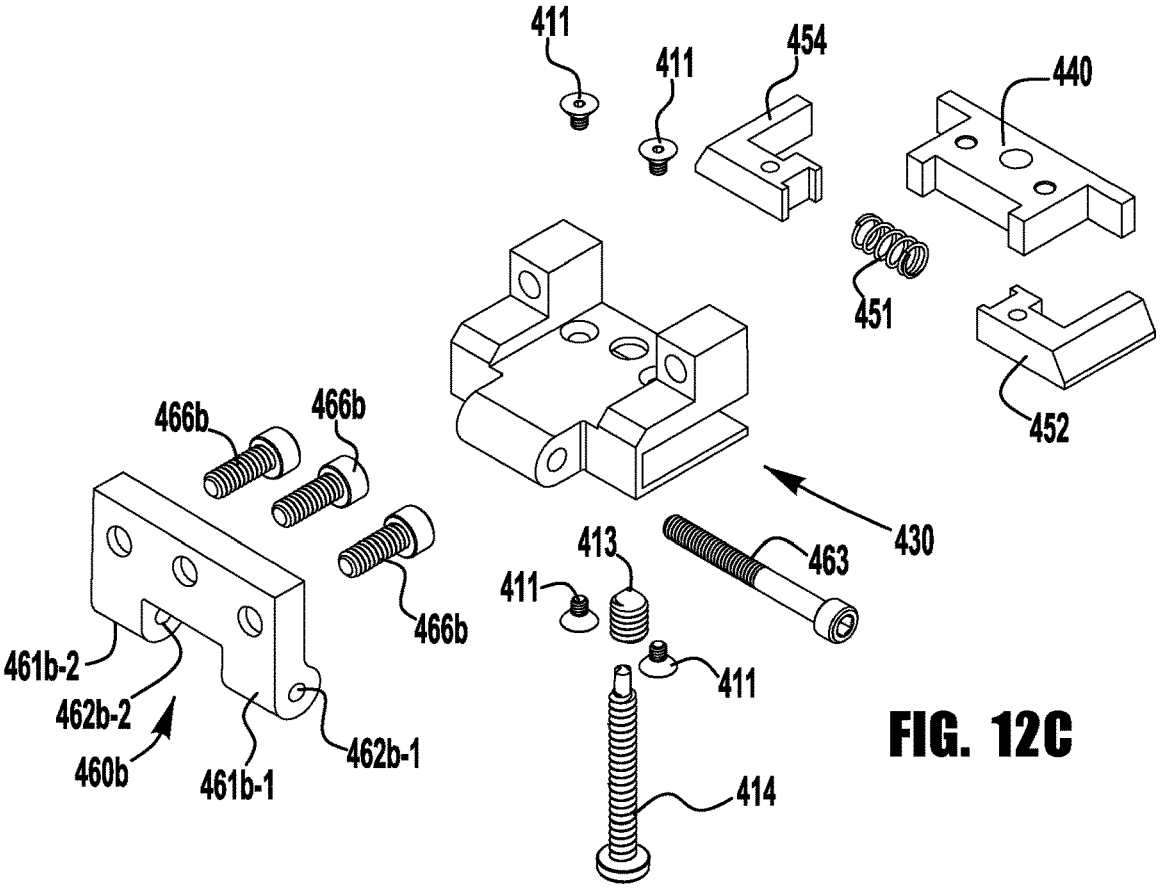
FIG. 12C is an exploded perspective view of the latch assembly of FIG. 12A.
Figure 12D:
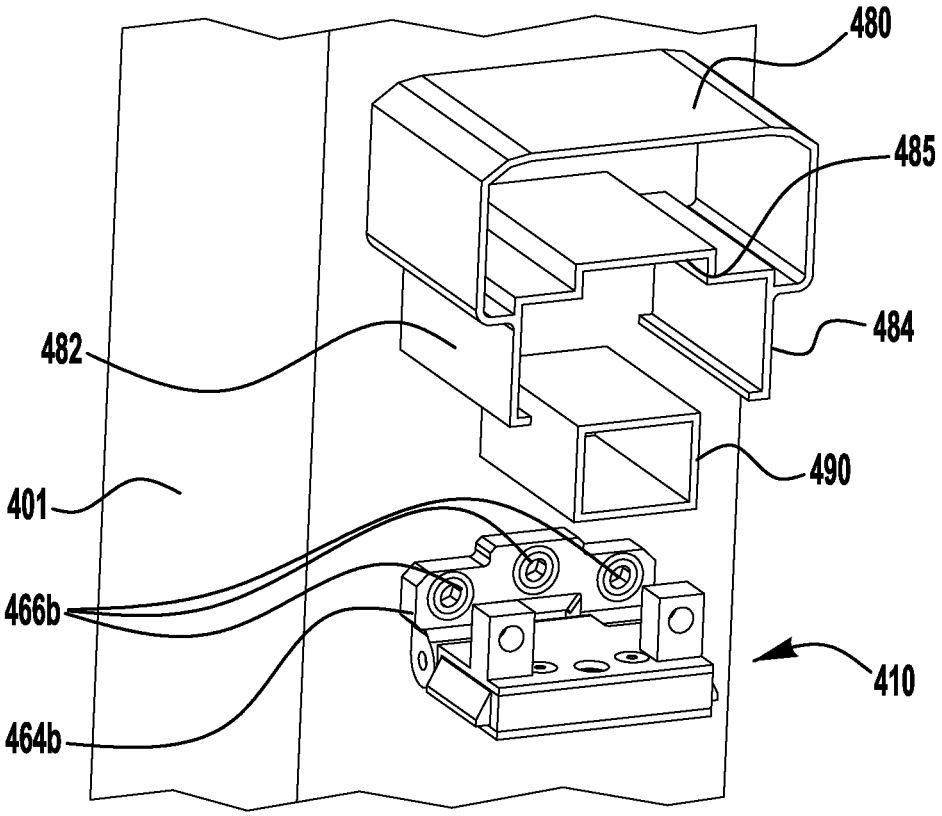
FIG. 12D is a perspective view of the latch assembly of FIG. 12A, shown hingedly mounted with a support structure prior to attachment with inner and outer rail members.
Figure 12E:
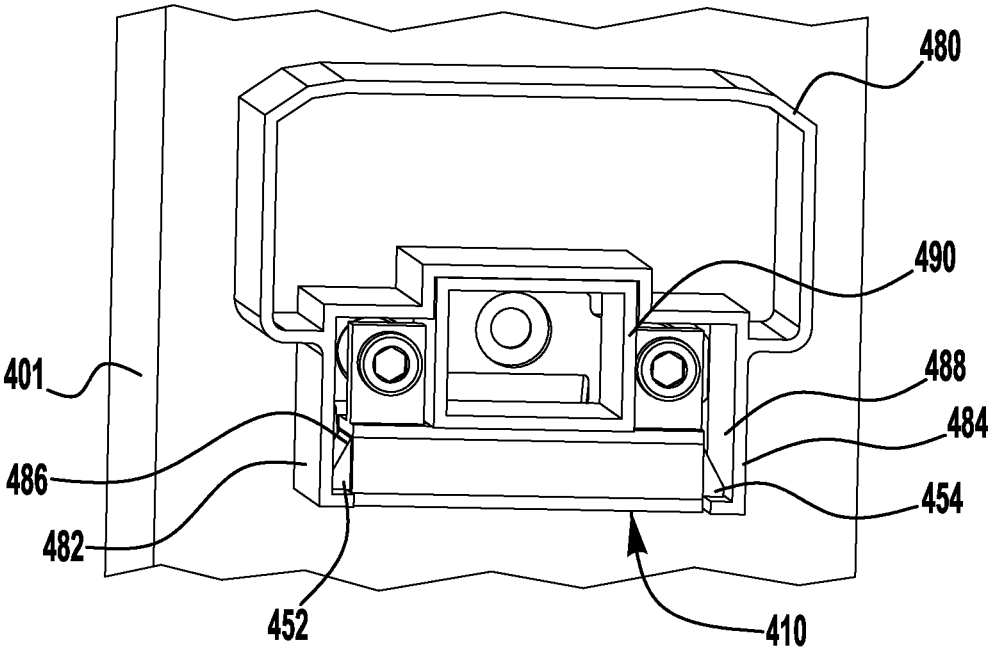
FIG. 12E is a perspective view of the latch assembly, support structure and inner and outer rail members of FIG. 12D, shown with the latch assembly attached with the inner and outer rail members for an angled railing configuration.

To provide for mounting of the latch assembly 410 for angled rail attachment (e.g., for a stairway rail), the mounting blocks 460*a*-1, 460*a*-2 may be removed and/or replaced/substituted with a hinge bracket attachable to the modular latch body housing 430. FIGS. 12A and 12B show the latch assembly 410*b* adapted for angled rail attachment, with the latch body housing 430 assembled with an exemplary hinge bracket 460*b* including apertured hinge portions 461*b*-1, 461*b*-2 received in the notched portions 438 of the body housing 430 for alignment of hinge bores 462*b*-1, 462*b*-2 with the body housing through bore 439 to receive the retaining fastener 463, which functions as a hinge pin. A mounting plate portion 464*b* extends from the hinge portions 461*b*-1, 461*b*-2 and includes mounting holes 465*b*-1, 465*b*-2, 465*b*-3 for mounting the hinge bracket 460*b* to a support structure 401 (FIGS. 12D-12E), for example, using mounting screws or other shorter fasteners 466*b*, in place of the longer fasteners 466*a* of the horizontal mount configuration.

Figure 12F:
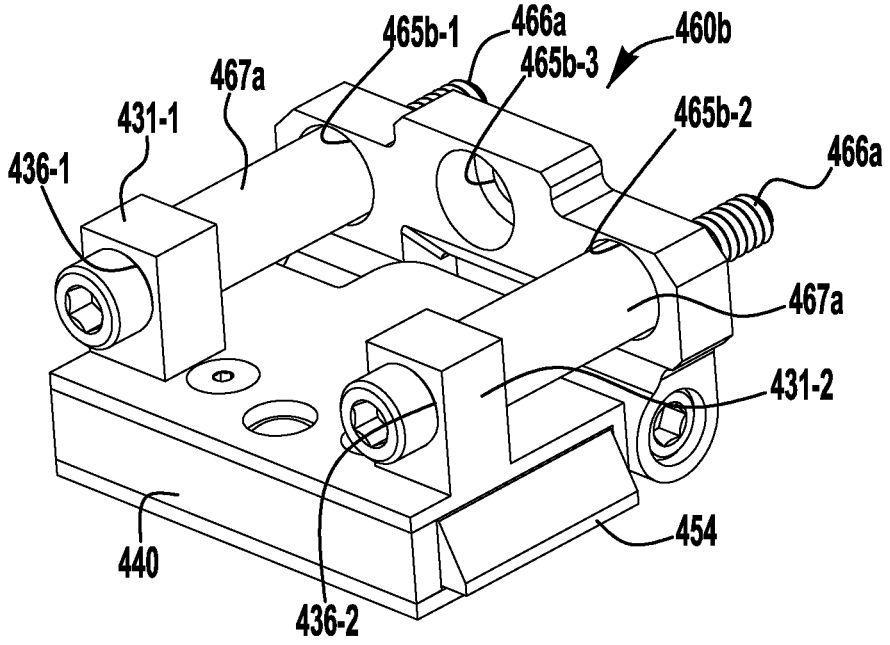
FIG. 12F is a perspective view of the latch assembly of FIG. 12A, shown with elongated fasteners for mounting in a horizontal configuration.

In other embodiments, a latch assembly may include a body housing and hinge bracket that have aligned mounting holes, such that longer mounting fasteners and installed through the aligned mounting holes when the latch assembly is used for attachment to a horizontal rail, and shorter mounting fasteners are installed through only the hinge bracket mounting holes when the latch assembly is used for attachment to an angled rail. In the embodiment of FIGS. 12A-12E, as shown in FIG. 12F, rather than replacing the hinge bracket 460*b* with mounting blocks (e.g., the mounting blocks 460*a*-1, 460*a*-2 of FIGS. 11A-11F) for a horizontal rail installation, the side mounting holes 465*b*-1, 465*b*-2 in the hinge bracket 460*b* may align with the apertures 436-1, 436-2 in the upper side walls 431-1, 431-2 of the body housing 430 to receive elongated fasteners 466*a* therethrough. As shown, elongated bushings or spacers 467*a* may be supplied over the fasteners 466*a* to provide reinforcing engagement between the hinge bracket 460*b* and the body housing upper side walls 431-1, 431-2.

FIGS. 13A-13E illustrate another embodiment of a latch assembly 510 having a latch body 520 formed from a U-shaped body housing 530 (e.g., U-shaped bracket) and a body block 540. The body housing 530 includes upper and lower wall portions 531, 533 extending between first and second ends or side edges 532, 534, a rear wall portion 535 extending between the upper and lower wall portions, and apertured flange tabs 531-1, 531-2 extending from the upper wall portion 531. The body block 540 is secured between the upper and lower wall portions 531, 533 (e.g., by screws or other such fasteners 511), and includes cutouts 542, 544 that, combined with the body housing 530, define first and second latch cavities that extend to the first and second side edges 532, 534 to receive and retain latch members 552, 554.

The body block 540 includes a rear hinge portion 547 that aligns with hinge portions 561-1, 561-2 of a hinge bracket 560 for hinged attachment using a hinge pin or other such fastener 563. The hinge bracket 560 includes apertured mounting portions 564-1, 564-2 that align with the apertured flange tabs 531-1, 531-2 when the latch body 520 is in a horizontal orientation, to allow for installation of longer mounting fasteners (not shown, but may be similar to the fasteners 466*a* of FIG. 12F) through the aligned apertures for attachment with a horizontal rail configuration. Elongated apertured spacers or bushings (not shown, but may be similar to the bushings 467*b* of FIG. 12F) may be slid over the mounting fasteners, between the apertured mounting portions 564-1, 564-2 and the apertured flange tabs 531-1, 531-2 to provide rigid, reinforcing support between the mounting portions and flange tabs.

To provide for mounting of the latch assembly 510 for angled rail attachment (e.g., for a stairway rail), the elongated fasteners (and spacers/bushings, where used) may be removed or omitted, allowing the latch body 520 to pivot with respect to the hinge bracket 560, at least over a desired range of angles (e.g., about 30° to about 50° above horizontal for latch securing lower end of inclined railing, to about 30° to about 50° below horizontal for latch securing upper end of inclined railing).

Figure 13A:
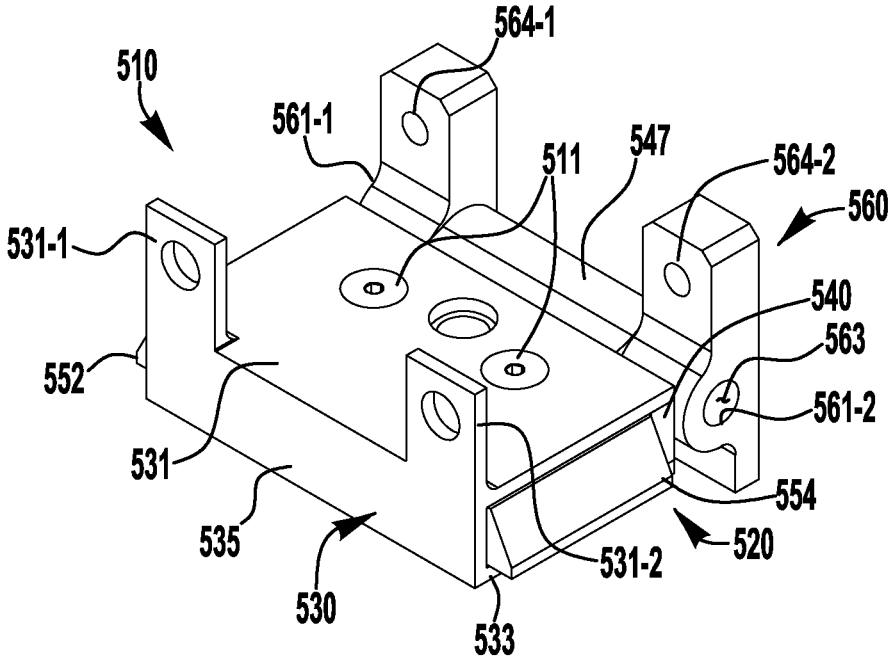
FIG. 13A is an upper front perspective view of another latch assembly having a hinge bracket for mounting a latched rail in an angled configuration.
Figure 13B:
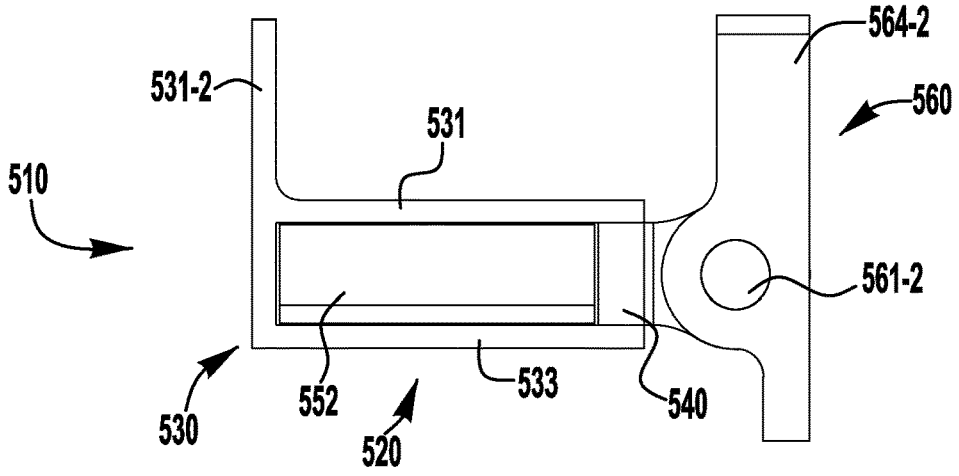
FIG. 13B is a side view of the latch assembly of FIG. 13A.
Figure 13C:
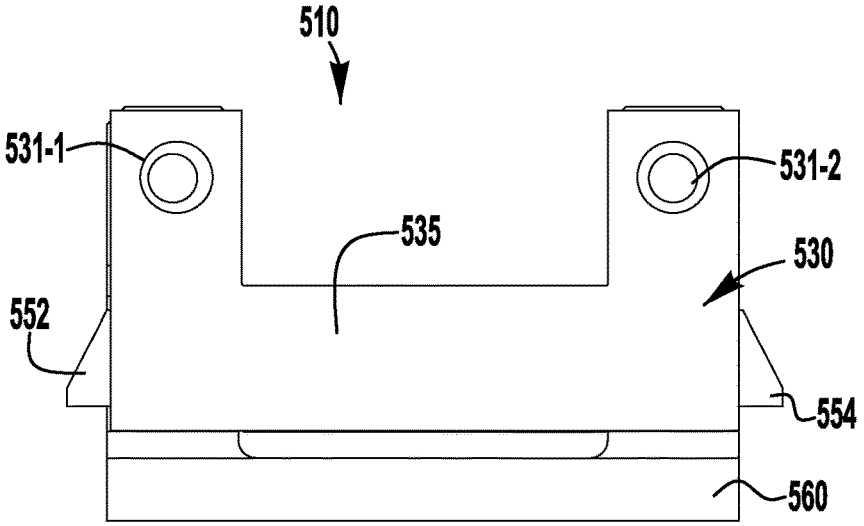
FIG. 13C is a front view of the latch assembly of FIG. 13A.
Figure 13D:
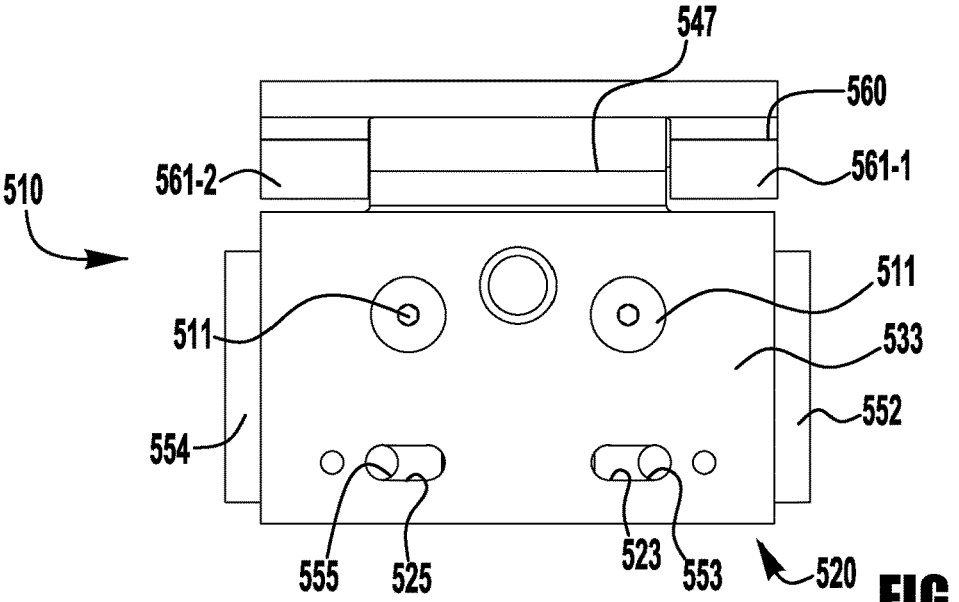
FIG. 13D is a bottom view of the latch assembly of FIG. 13A.
Figure 13E:
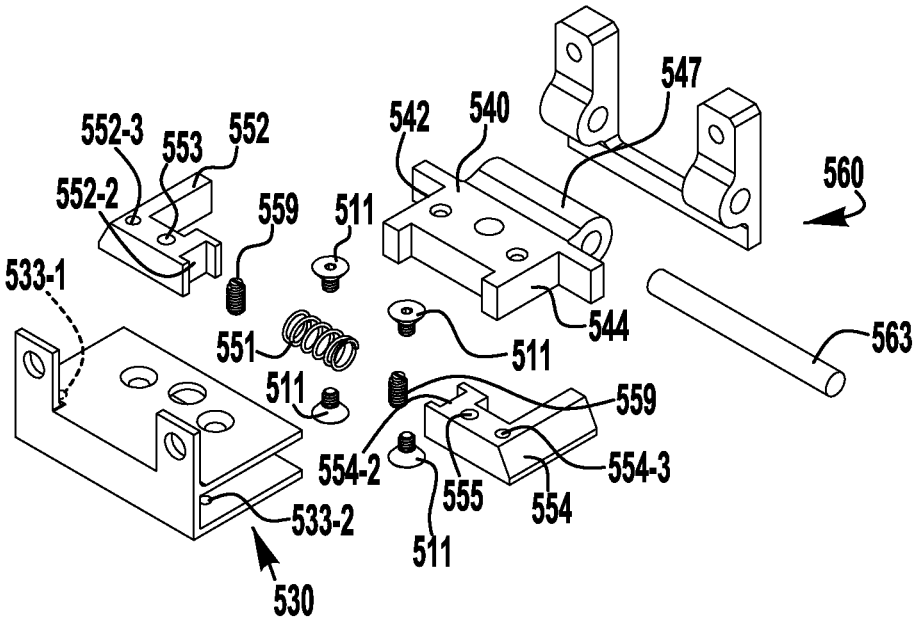
FIG. 13E is an exploded perspective view of the latch assembly of FIG. 13A.
Figure 13F:
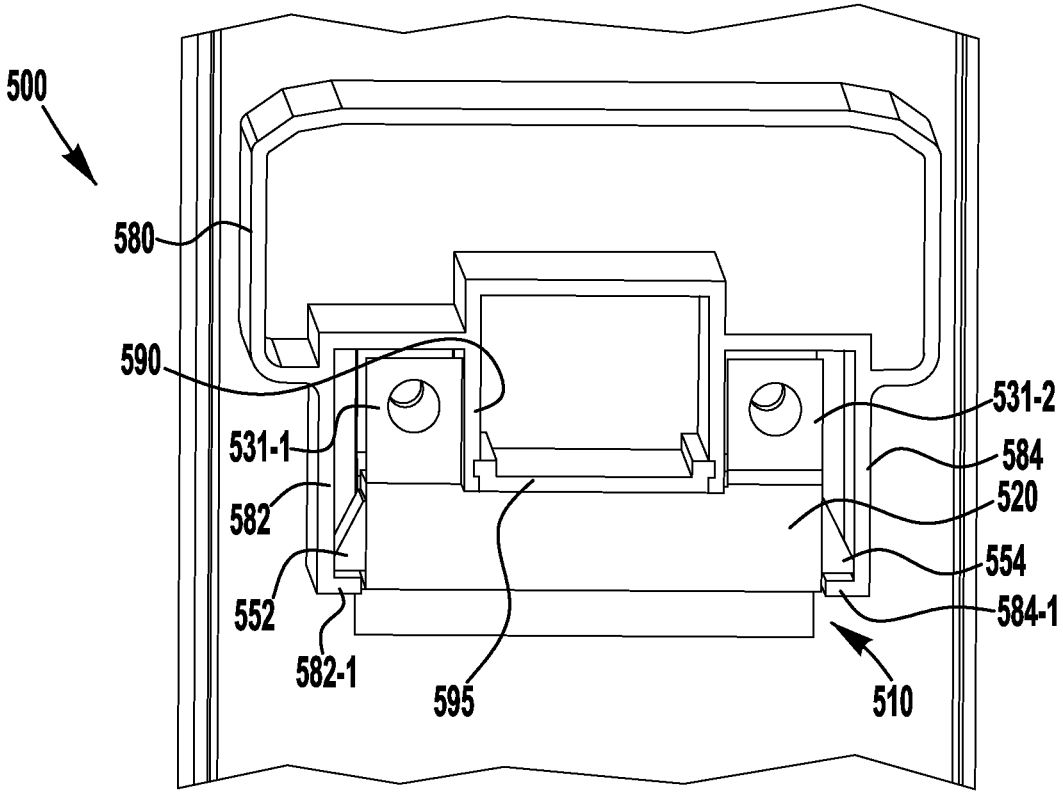
FIG. 13F is a perspective view of the latch assembly of FIG. 13A, shown attached with a support structure and inner and outer rail members.

As shown, the flange tabs 531-1, 531-2 and hinge bracket mounting portions 564-1, 564-2 may define a central space for receiving an inner rail portion. While the latch assembly may be used with a two-piece railing arrangement including inner and outer rail members (e.g., the outer and inner rail members 480, 490 of FIGS. 11E, 11F, 12D, and 12E), other railing arrangements may be used. As shown in FIG. 13F, the latch assembly 510 may be used in a railing system 500 with a monolithic railing including an inner rail portion 590 integrally formed with an outer rail portion 580, with the inner rail portion received in the central space of the latch body 520, and the outer rail portion defining an outer surface of the railing and the rail side portions 582, 584 for interlocking with the latch members 552, 554. As shown, a separate plate 595 may be assembled with the inner rail portion 590 (e.g., received in grooved portions of the inner rail portion) to provide for customized attachment to railing slats or other features.

The latch members 552, 554 are retained in the first and second latch cavities and are laterally slideable between an extended position in which end portions 552-1, 554-1 extend outward of the body housing side edges 532, 534, and a retracted position, in which the latch members 552, 554 are fully received within the latch cavities, thereby disengaging from the rail side portions 582, 584. The exemplary latch members 552, 554 include an inner lateral foot portion 552-2, 554-2 retained in inner recesses of the latch cavities, which may be sized to define lateral limit positions of the latch members.

The exemplary latch members 552, 554 are spring biased to the extended position by a coil spring 551 or other such spring member(s) disposed in the latch body 520 between the foot portions 552-2, 554-2 of the latch members. The exemplary latch members 552, 554 are provided with chamfered end portions 552-1, 554-1 contoured such when the latch assembly 510 is inserted into the rail cavity 583, flanged end portions 582-1, 584-1 of the rail side portions 582, 584 engage the chamfered end portions 552-1, 554-1 of the latch members to force the latch members against the spring biasing forces to slide the latch members to the retracted position. When the latch assembly 510 is fully installed in the rail cavity, the coil spring 551 forces the latch members 552, 554 laterally outward to the extended position for interlocking engagement of the latch end portions 552-1, 554-1 with the rail side portions.

To facilitate initial installation and subsequent detachment of the latch assembly 510, the latch assembly may be provided with detent features that hold the latch members in the retracted position until they are manually released by the user to the extended position. In the exemplary embodiment of FIGS. 13A-13F, as shown in FIG. 13E, spring plungers 559 are assembled with the latch members 552, 554 (e.g., in holes 552-3, 554-3), and are spring biased into seating engagement with detent holes 533-1, 533-2 in the lower body housing wall portion 533 when the latch members 552, 554 are in the retracted position.

To provide for user retraction of the latch members 552, 554, the latch members are provided with latch release features for sliding movement of the latch members. While a variety of structures may be used, in the illustrated embodiment, the latch members 552, 554 include tool engagement portions (e.g., holes 553, 555) accessible through slotted portions 523, 525 (e.g., separate openings or portions of the same opening) in the latch body 520 (e.g., in the lower body housing wall portion 533). To detach the railing from the latch assembly 510, screwdrivers, pliers, or other such tools may be inserted into the tool engagement holes 553, 555 and manipulated to retract the latch members 552, 554 into the latch body 520 and out of engagement with the rail side portions.

To rigidly secure the rail 580 to the latch assembly 510 (e.g., for weight bearing railing applications), the latch assembly may be provided with one or more set screws 513, installed in a threaded hole 543 in the body block 540, that may be tightened into clamping engagement with the rail (e.g., with the inner rail member 590, as shown). In other embodiments (not shown), one or more fasteners may be installed through aligned mounting holes in the latch body and rail for more secure attachment of the rail to the support structure.

Figure 14:
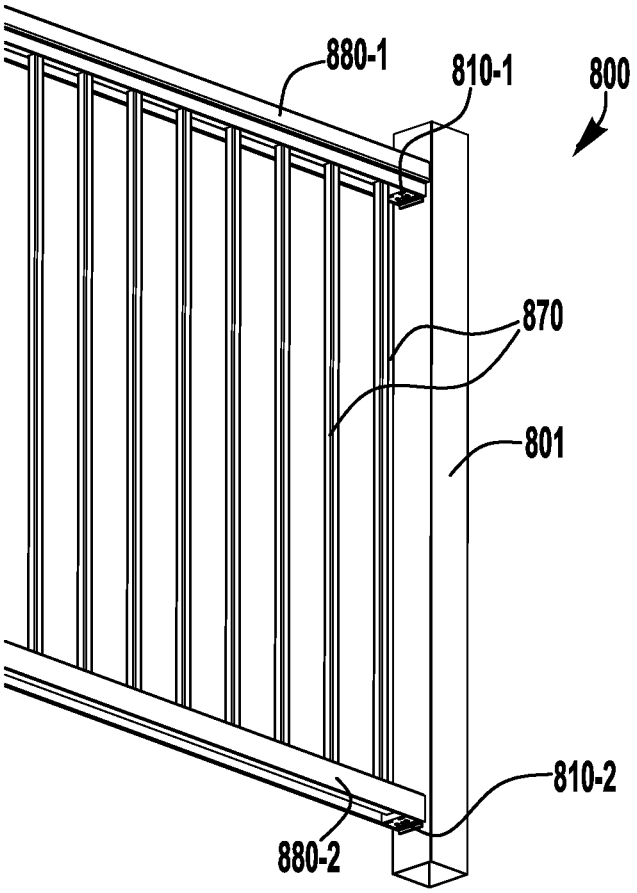
FIG. 14 is a perspective view of a railing system including upper and lower rails supporting one or more barrier elements, according to an exemplary embodiment of the present disclosure.
Figure 15A:
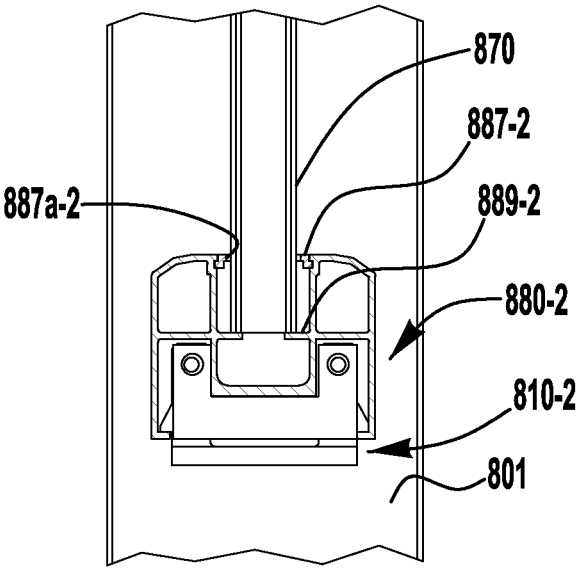
FIG. 15A is a front cross-sectional view of a lower portion of the railing system of FIG. 14.
Figure 15B:
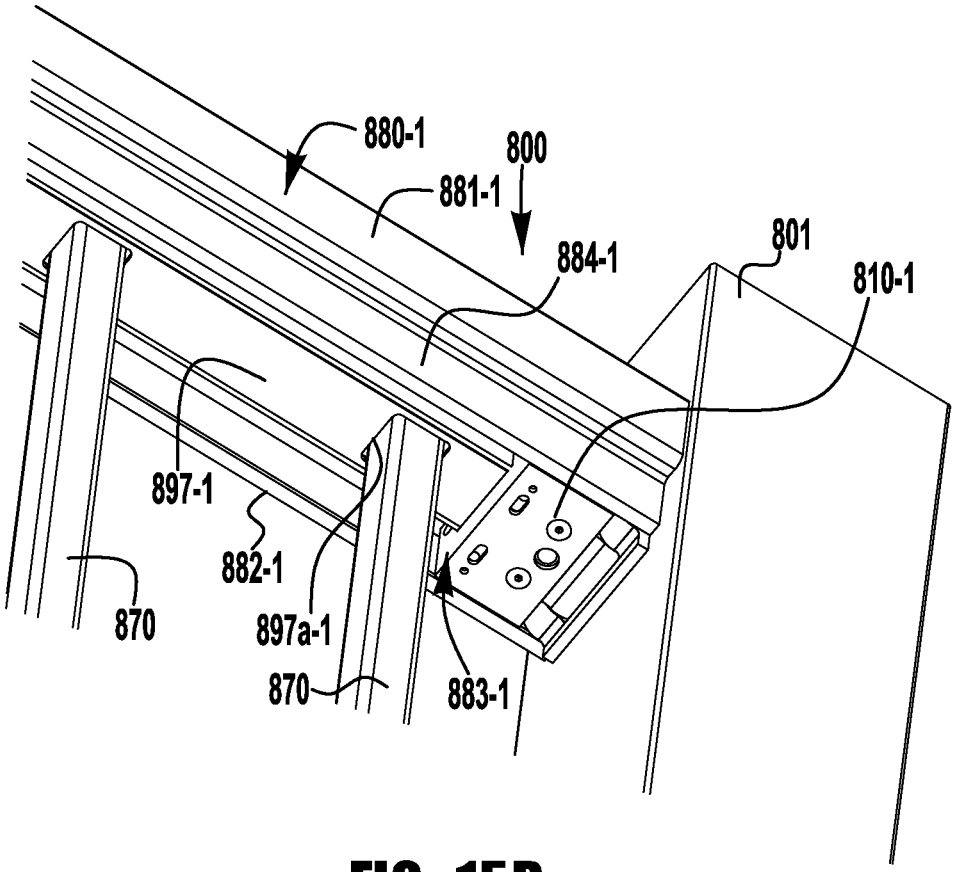
FIG. 15B is a lower perspective view of an upper portion of the railing system of FIG. 14.

According to another aspect of the present disclosure, a barrier railing system may include upper and lower rails independently attached to a support structure (e.g., post or wall) by upper and lower latch assemblies (e.g., any of the latch assemblies described herein) mounted to the support structure. FIGS. 14, 15A, and 15B illustrate an exemplary railing system 800 including upper and lower latch assemblies 810-1, 810-2 (e.g., any of the latch assemblies described herein) mountable to a post or other such support structure 801 for latching attachment of upper and lower rails 880-1, 880-2 to the support structure. The rails 880-1, 880-2 each include an elongated body portion 881-1, 881-2 and first and second side portions 882-1, 884-1, 882-2, 884-2, which may extend from the body portion to define rail cavities 883-1, 883-2 for receiving and interlocking with the latch assemblies 810-1, 810-2, as described in greater detail above.

The exemplary lower rail member 880-2 includes an upper wall portion 887-2 defining one or more apertures 887*a*-2 receiving lower ends of one or more barrier elements 870 (e.g., slats or balusters), and an internal base wall 889-2 supporting the lower ends of the barrier elements 870. The barrier element(s) may include, for example, one or more panels, rods, slats, or balusters. While the apertured wall portion 887-2 may be integrally formed with the rail 880-2, in the illustrated embodiment, the wall portion 887-2 comprises a plate assembled with a grooved portion of the rail 880-2, for example, to allow for use of the same rail 880-2 with a variety of barrier elements, by replacing the wall portion plate 887-2.

The exemplary upper rail includes a lower wall portion 897-1 defining one or more apertures 897*a*-1 receiving the upper end(s) of the barrier element(s) 870. While the apertured wall portion 897-1 may be integrally formed with the rail 880-1, in the illustrated embodiment, the wall portion 897-1 comprises a plate assembled with a grooved portion of the rail 880-1, for example, to allow for use of the same rail 880-1 with a variety of barrier elements, by replacing the wall portion plate 897-1.

FIGS. 16A-16G illustrate another embodiment of a latch assembly 610 having a latch body 620 formed from a flanged bracket 630 and an upper plate 640. The bracket 630 includes a lower wall portion 633 extending between first and second ends or side edges 632, 634, a rear wall portion 635 extending from the lower wall portion, and apertured flange tabs 631-1, 631-2 extending from the rear wall portion 635. The upper plate 640 is secured to the lower wall portion 633 of the bracket 630 by fasteners 611 (e.g., rivets) through slots 623, 625 in latch members 652, 654 (FIG. 16E) captured between the upper plate and the lower wall portion, which may provide lateral limit positions for the latch members.

The lower wall portion 633 of the bracket 630 includes a rear hinge portion 637 that aligns with hinge portions 661-1, 661-2 of a hinge bracket 660 for hinged attachment using a hinge pin 663 or other such fastener. The hinge bracket 660 includes apertured mounting portions 664-1, 664-2 that align with the apertured flange tabs 631-1, 631-2 when the latch body 620 is in a horizontal orientation, to allow for installation of longer mounting fasteners 666*a* through the aligned apertures for attachment with a horizontal rail configuration to a support structure. Elongated apertured spacers or bushings (not shown, but may be similar to bushings 467*a* of FIG. 12F) may be slid over the mounting fasteners 666*a*, between the apertured mounting portions 664-1, 664-2 and the apertured flange tabs 631-1, 631-2 to provide rigid, reinforcing support between the mounting portions and flange tabs. As shown, the flange tabs 631-1, 631-2 and hinge bracket mounting portions 664-1, 664-2 may define a central space for receiving an inner rail portion 690 (FIG. 1W). A lower portion 668 of the hinge bracket 660 may include additional mounting holes to further secure the hinge bracket to the support structure.

The latch members 652, 654 are laterally slideable between an extended position in which end portions 652-1, 654-1 extend outward of the body housing side edges 632, 634, and a retracted position, in which the latch members 652, 654 are fully received between the upper plate 640 and the lower wall portion 633 of the bracket 630, inward of the side edges 632, 634, thereby disengaging from the rail side portions 682, 684.

The exemplary latch members 652, 654 are spring biased to the extended position by coil springs 651 or other such spring members disposed between the latch members. The exemplary latch members 652, 654 are provided with chamfered end portions 652-1, 654-1 contoured such when the latch assembly 610 is inserted into the rail cavity 683, flanged end portions 682-1, 684-1 of the rail side portions 682, 684 engage the chamfered end portions 652-1, 654-1 of the latch members to force the latch members against the spring biasing forces to slide the latch members to the retracted position. When the latch assembly 610 is fully installed in the rail cavity 683, the coil springs 651 forces the latch members 652, 654 laterally outward to the extended position for interlocking engagement of the latch end portions 652-1, 654-1 with the rail side portions 682, 684.

Figure 16A:
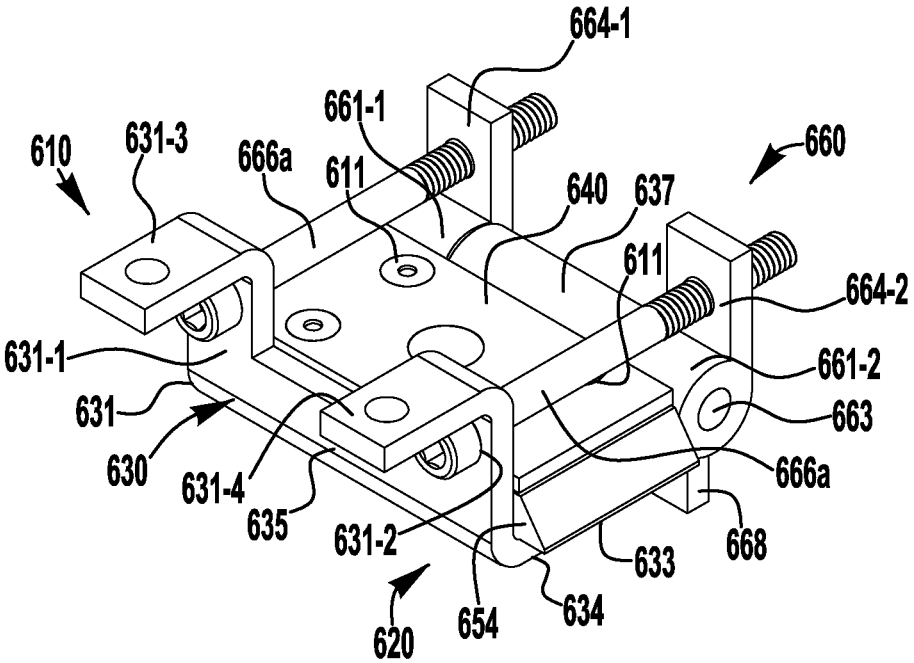
FIG. 16A is an upper front perspective view of another latch assembly having a hinge bracket for mounting a latched rail in an angled configuration.
Figure 16B:
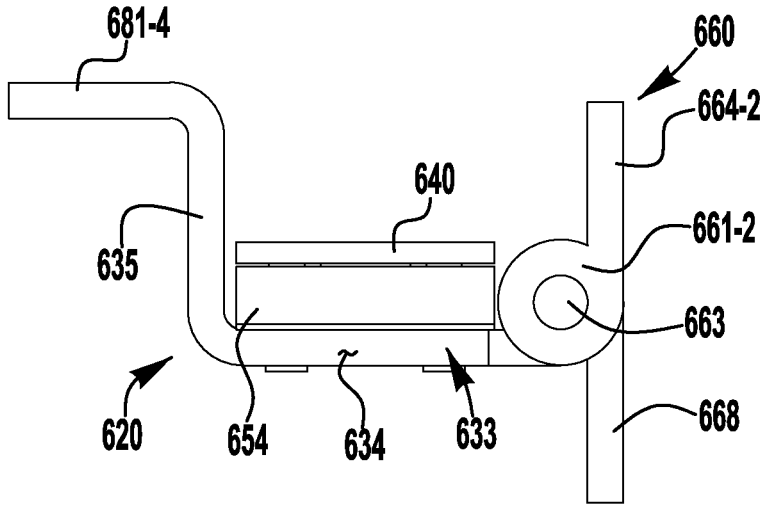
FIG. 16B is a side view of the latch assembly of FIG. 16A.
Figure 16C:
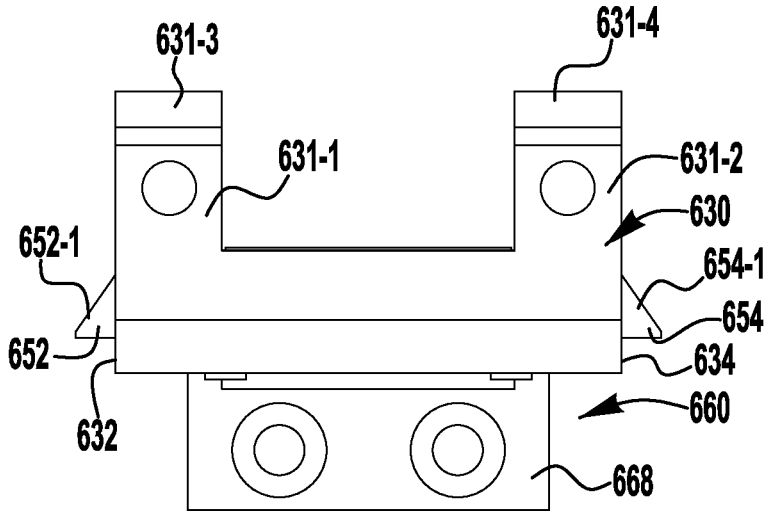
FIG. 16C is a front view of the latch assembly of FIG. 16A.
Figure 16D:
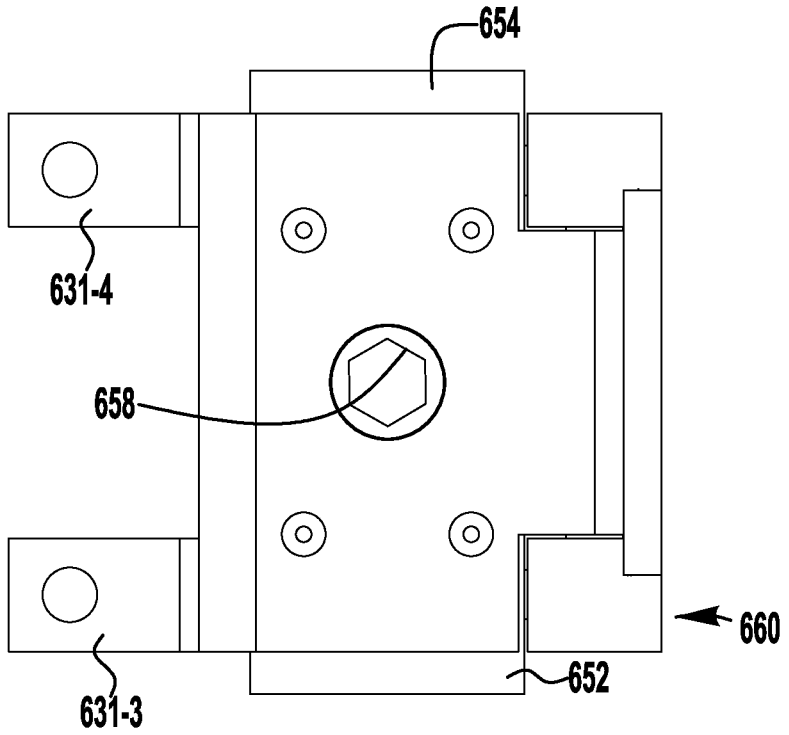
FIG. 16D is a bottom view of the latch assembly of FIG. 16A.
Figure 16E:
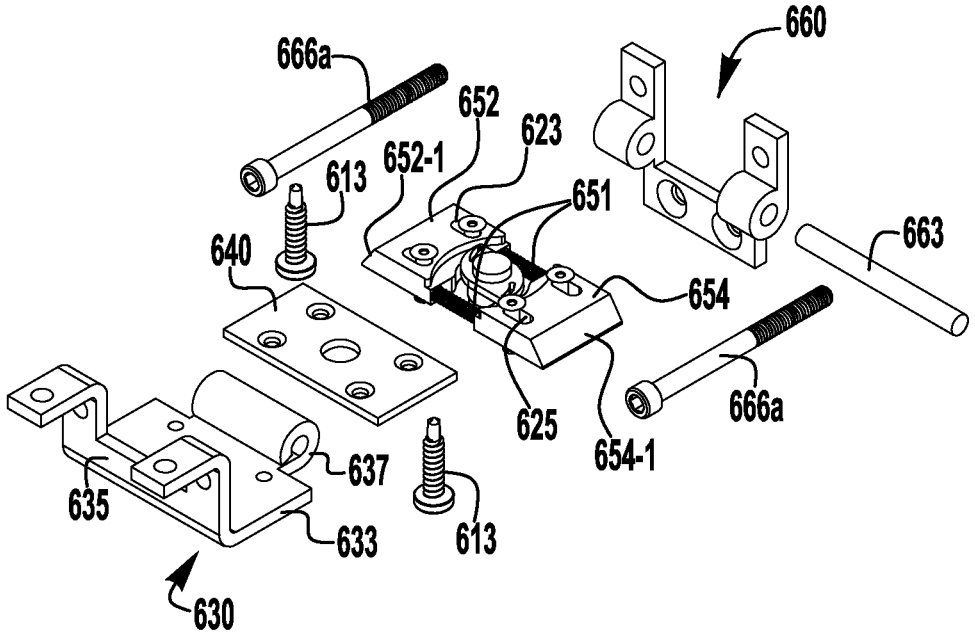
FIG. 16E is an exploded perspective view of the latch assembly of FIG. 16A.
Figure 16F:
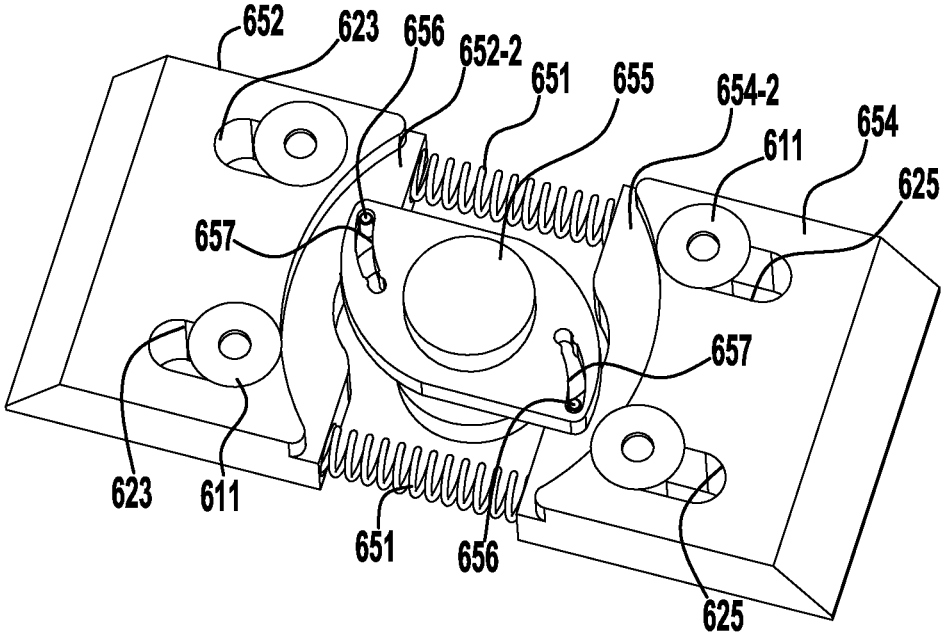
FIG. 16F is a perspective view of the latch release mechanism of the latch assembly of FIG. 16A.
Figure 16G:
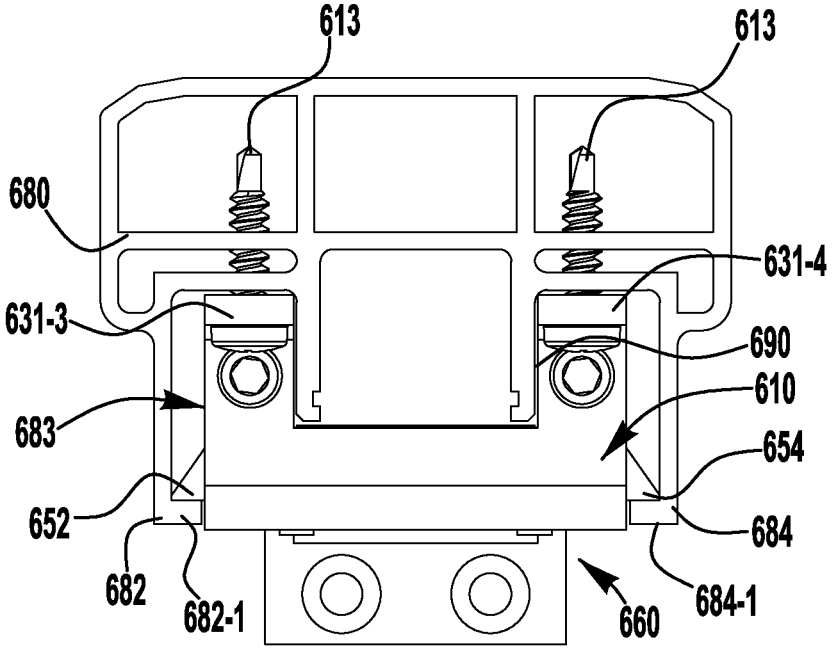
FIG. 16G is a front view of the latch assembly of FIG. 16A, attached with the a railing in a horizontal configuration.

To provide for user retraction of the latch members 652, 654, the latch members are provided with latch release features for sliding movement of the latch members. While a variety of structures may be used, in the illustrated embodiment, as best shown in FIG. 16F, the latch members 652, 654 include inner lateral foot portions 652-2, 654-2 that are linked with an actuating cam 655 that is rotatable for sliding movement of the latch members between the retracted and extended positions. In the illustrated example, the latch foot portions 652-1, 654-2 include fixed protrusions 656 (e.g., roll pins) received in arcuate slots 657 in the actuating cam 655. When the actuating cam 655 is rotated, the protrusions 656 ride in the arcuate slots 657 to laterally slide the latch members 652, 654 from the extended position to the retracted position to detach the rail 680 from the latch assembly 610. While the actuating cam 655 may be provided with any suitable user engageable portion to facilitate rotation, in the illustrated embodiment, the actuating cam is provided with a hex-shaped bore 658 (FIG. 16D) for engagement and actuation using, for example, a hex key or Allen wrench.

In some embodiments (e.g., decorative, non-weight bearing railings), latch member attachment of the railing to the support structure may adequately secure the railing. In other embodiments (e.g., weight bearing railings), reinforced attachment of the railing to the support structure may be desired. To rigidly secure the rail 680 to the latch assembly 610, the latch assembly may be provided with one or more fasteners 613 (e.g., mounting screws), installed in mounting tabs 631-3, 631-4 extending from the flange tabs 631-1, 631-2, that may be tightened against or through the outer rail portion 680.

To provide for mounting of the latch assembly 610 for angled rail attachment (e.g., for a stairway rail), the elongated fasteners 666*a* (and spacers/bushings, where used) may be removed or omitted, and replaced with shorter fasteners (not shown, but may be similar to shorter fasteners 466*b* of FIGS. 12A-12D) extending through only the apertured mounting portions 664-1, 664-2, allowing the latch body 620 to pivot with respect to the hinge bracket 660, at least over a desired range of angles (e.g., about 30° to about 50° above horizontal for latch securing lower end of inclined railing, to about 30° to about 50° below horizontal for latch securing upper end of inclined railing).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. A latch assembly comprising:

a latch body including a longitudinal wall portion extending from a front wall portion to a rear hinge portion;

first and second latch members assembled with the longitudinal wall portion and laterally movable between an extended position and a retracted position; and a hinge bracket defining a mounting surface, the hinge bracket being hingedly attached to the rear hinge portion of the latch body for angular adjustment of the latch body with respect to the mounting surface, wherein when the latch body is oriented at a first angle, first and second mounting apertures in the front wall portion align with first and second mounting apertures in the hinge bracket, such that installation of mounting fasteners through the corresponding first and second mounting apertures of the front wall portion and the hinge bracket secures the latch body at the first angle.

2. The latch assembly of claim 1, further comprising a latch release mechanism operable to move the first and second latch members from the extended position to the retracted position.

3. The latch assembly of claim 2, wherein the latch release mechanism comprises first and second latch release features disposed on the first and second latch members.

4. The latch assembly of claim 3, wherein the first and second latch release features extend through or are accessible through first and second slotted portions in the latch body.

5. The latch assembly of claim 2, wherein the latch release mechanism comprises a user rotatable cam linked with the first and second latch members for sliding movement of the first and second latch members from the extended position to the retracted position.

6. The latch assembly of claim 1, wherein the first and second latch members are spring biased laterally outward toward the extended position.

7. The latch assembly of claim 6, further comprising at least one spring member disposed in the latch body between the first and second latch members to spring bias the first and second latch members laterally outward of the latch body.

8. The latch assembly of claim 1, wherein the first and second latch members include inner lateral foot portions retained in inner recesses of the latch body sized to define lateral limit positions of the first and second latch members.

9. The latch assembly of claim 1, wherein the first angle is substantially perpendicular to the mounting surface.

10. In combination, a rail and a latch assembly for attaching the rail to a support structure, the rail including an elongated body portion, first and second side portions, and a cavity disposed between the first and second side portions, the latch assembly comprising:

a latch body received in the rail cavity and including a longitudinal wall portion extending to a rear portion;

first and second latch members assembled with the longitudinal wall portion and laterally movable between an extended position in interlocking engagement with the first and second side portions of the rail and a retracted position disengaged from the first and second side portions of the rail; and a mounting bracket attached to the rear portion of the latch body and defining a mounting surface for mounting the latch body to the support structure wherein the rail comprises an outer rail portion defining the body portion and the first and second side portions, and an inner rail portion received in a central space defined by the latch body and the mounting bracket.

11. The combination of claim 10, wherein the mounting bracket is hingedly attached to the rear portion of the latch body for angular adjustment of the latch body with respect to the mounting surface.

12. The combination of claim 11, wherein when the latch body is oriented at a first angle, first and second mounting apertures in a front wall portion of the latch body align with first and second mounting apertures in the mounting bracket, such that installation of mounting fasteners through the corresponding first and second mounting apertures of the front wall portion and the hinge bracket secures the latch body at the first angle.

13. The combination of claim 10, wherein the first and second side portions of the rail comprise first and second flanges defining inward facing first and second side channels receiving the first and second latch members.

14. The combination of claim 10, wherein the outer rail portion comprises an outer rail member and the inner rail portion comprises an inner rail member separate from the outer rail member, the inner rail member being captured between the outer rail member and the latch assembly.

15. The combination of claim 10, wherein the outer rail portion and the inner rail portion are formed from an integral, monolithic railing member.

16. The combination of claim 10, further comprising at least one fastener installed through a mounting hole in the latch body for engagement with the rail, to further secure the latch assembly to the rail.

17. The combination of claim 10, further comprising a latch release mechanism operable to move the first and second latch members from the extended position to the retracted position.

18. In combination, a rail and a latch assembly for attaching the rail to a support structure, the rail including an elongated body portion, first and second side portions, and a cavity disposed between the first and second side portions, the latch assembly comprising:

a latch body received in the rail cavity and including a longitudinal wall portion extending to a rear portion;

first and second latch members assembled with the longitudinal wall portion and laterally movable between an extended position in interlocking engagement with the first and second side portions of the rail and a retracted position disengaged from the first and second side portions of the rail; and a mounting bracket attached to the rear portion of the latch body and defining a mounting surface for mounting the latch body to the support structure;

wherein the mounting bracket is hingedly attached to the rear portion of the latch body for angular adjustment of the latch body with respect to the mounting surface; and wherein when the latch body is oriented at a first angle, first and second mounting apertures in a front wall portion of the latch body align with first and second mounting apertures in the mounting bracket, such that installation of mounting fasteners through the corresponding first and second mounting apertures of the front wall portion and the hinge bracket secures the latch body at the first angle.

19. The combination of claim 18, wherein the first and second side portions of the rail comprise first and second flanges defining inward facing first and second side channels receiving the first and second latch members.

20. The combination of claim 18, wherein the rail comprises an outer rail portion defining the body portion and the first and second side portions, and an inner rail portion received in a central space defined by the latch body and the mounting bracket.

* * * * *